US010194258B2

(12) United States Patent
Lacouture Parodi

(10) Patent No.: US 10,194,258 B2
(45) Date of Patent: Jan. 29, 2019

(54) AUDIO SIGNAL PROCESSING APPARATUS AND METHOD FOR CROSSTALK REDUCTION OF AN AUDIO SIGNAL

(71) Applicant: Huawei Technologies Co., Ltd., Shenzhen (CN)

(72) Inventor: Yesenia Lacouture Parodi, Munich (DE)

(73) Assignee: Huawei Technologies Co., Ltd., Shenzhen (CN)

( * ) Notice: Subject to any disclaimer, the term of this patent is extended or adjusted under 35 U.S.C. 154(b) by 0 days.

(21) Appl. No.: 15/656,912

(22) Filed: Jul. 21, 2017

(65) Prior Publication Data

US 2017/0325042 A1 Nov. 9, 2017

Related U.S. Application Data

(63) Continuation of application No. PCT/EP2015/053231, filed on Feb. 16, 2015.

(51) Int. Cl.

*H04S 7/00* (2006.01)
*H04S 1/00* (2006.01)
*H04S 3/00* (2006.01)

(52) U.S. Cl.

CPC ..... *H04S 7/30* (2013.01); *H04S 1/002* (2013.01); *H04S 3/002* (2013.01); *H04S 2400/01* (2013.01); *H04S 2420/01* (2013.01)

(58) Field of Classification Search

CPC ..... H04S 7/30; H04S 3/002; H04S 2400/01; H04S 1/002; H04S 2420/01

(Continued)

(56) References Cited

U.S. PATENT DOCUMENTS 5,305,386 A * 4/1994 Yamato ..... H04S 7/302 381/1
5,862,227 A 1/1999 Orduna-Bustamante et al.

(Continued)

FOREIGN PATENT DOCUMENTS

CN 101946526 A 1/2011
CN 104219604 A 12/2014

(Continued)

OTHER PUBLICATIONS

Baluert., "Spatial Hearing," Massachusetts Institute of Technology, pp. 148-155, The MIT Press, Revised Edition, Cambridge, Massachusetts (1996).

(Continued)

*Primary Examiner* — Vivian Chin
*Assistant Examiner* — Douglas Suthers
(74) *Attorney, Agent, or Firm* — Leydig, Voit & Mayer, Ltd.

(57) ABSTRACT

The disclosure relates to an audio signal processing apparatus for filtering a left channel input audio signal (L) and a right channel input audio signal (R), a left channel output audio signal ($X_1$) and a right channel output audio signal ($X_2$) to be transmitted over acoustic propagation paths to a listener, wherein transfer functions of the acoustic propagation paths are defined by an acoustic transfer function matrix. The audio signal processing apparatus comprises a decomposer, a first cross-talk reducer, a second cross-talk reducer, and a combiner. The first cross-talk reducer is configured to reduce a cross-talk within a first predetermined frequency band upon the basis of the acoustic transfer function matrix. The second cross-talk reducer is configured to reduce a cross-talk within a second predetermined frequency band upon the basis of the acoustic transfer function matrix.

15 Claims, 11 Drawing Sheets

(58) Field of Classification Search
USPC ..... 381/303
See application file for complete search history.

(56) References Cited

U.S. PATENT DOCUMENTS

| | | | | |
|---|---|---|---|---|
| 6,424,719 | B1 * | 7/2002 | Elko | H04S 1/00 381/1 |
| 8,116,479 | B2 | 2/2012 | Hamada et al. | |
| 2004/0170281 | A1 | 9/2004 | Nelson et al. | |
| 2007/0133831 | A1 | 6/2007 | Kim et al. | |
| 2009/0022328 | A1 | 1/2009 | Neugebauer et al. | |
| 2011/0194712 | A1 | 8/2011 | Potard | |
| 2013/0163766 | A1 | 6/2013 | Choueiri | |

FOREIGN PATENT DOCUMENTS

| | | | |
|---|---|---|---|
| EP | 1545154 | A2 | 6/2005 |
| EP | 1927266 | B1 | 5/2014 |
| JP | H108182100 | A | 7/1996 |
| JP | H10509565 | A | 9/1998 |
| KR | 20070033860 | A | 3/2007 |
| RU | 2444154 | C2 | 2/2012 |
| WO | 9730566 | A1 | 8/1997 |
| WO | 03053099 | A1 | 6/2003 |
| WO | 2009102750 | A1 | 8/2009 |
| WO | 2014151817 | A1 | 9/2014 |

OTHER PUBLICATIONS

Bradley et al., "Rank Analysis of Incomplete Block Designs: I. The Method of Paired Comparisons," Biometrika, vol. 39, No. 3/4, pp. 324-345, Biometrika Trust (Dec. 1952).

Nelson et al., "Adaptive Inverse Filters for Stereophonic Sound Reproduction," IEEE Transactions on Signal Procession, vol. 40, No. 7, pp. 1621-1633, XP000307653, Institute of Electrical and Electronics Engineers, New York, New York (Jul. 1992).

Takeuchi et al., "Optimal source distribution for binaural synthesis over loudspeakers," Acoustics Research Letters online 2, http://dx.doi.org/10.1121/1.1346898, Acoustical Society of America, (Published Online Dec. 28, 2000).

Bai et al., "Comparative study of audio spatializers for dual-loudspeaker mobile phones," J. Acoust. Soc. Am. 121(1), pp. 298-309, Acoustical Society of America (Jan., 2007).

Choueiri et al., "Optimal Crosstalk Cancellation for Binaural Audio with Two Loudspeakers," pp. 1-24, Princeton University, (2011).

Blauert, "Spatial Hearing," Massachusetts Institute of Technology, pp. 148-155, The Mit Press, Revised Edition, Cambridge, Massachusetts (1996).

Bradley et al., "Rank Analysis of Incomplete Block Designs: I. The Method of Paired Comparisons," Biometrika, vol. 39, No. 314, pp. 324-345, Biometrika Trust (Dec. 1952).

* cited by examiner

AUDIO SIGNAL PROCESSING APPARATUS AND METHOD FOR CROSSTALK REDUCTION OF AN AUDIO SIGNAL

CROSS-REFERENCE TO RELATED APPLICATIONS

This application is a continuation of International Application No. PCT/EP2015/053231, filed on Feb. 16, 2015, the disclosure of which is hereby incorporated by reference in its entirety.

TECHNICAL FIELD

The disclosure relates to the field of audio signal processing, in particular to cross-talk reduction within audio signals.

BACKGROUND

The reduction of cross-talk within audio signals is of major interest in a plurality of applications. For example, when reproducing binaural audio signals for a listener using loudspeakers, the audio signals to be heard e.g. in the left ear of the listener are usually also heard in the right ear of the listener. This effect is denoted as cross-talk and can be reduced by adding an inverse filter into the audio reproduction chain. Cross-talk reduction can also be referred to as cross-talk cancellation, and can be realized by filtering the audio signals.

An exact inverse filtering is usually not possible and approximations are applied. Because inverse filters are normally unstable, these approximations use a regularization in order to control the gain of the inverse filters and to reduce the dynamic range loss. However, due to ill-conditioning, the inverse filters are sensitive to errors. In other words, small errors in the reproduction chain can result in large errors at a reproduction point, resulting in a narrow sweet spot and undesired coloration as described in Takeuchi, T. and Nelson, P. A., "Optimal source distribution for binaural synthesis over loudspeakers", Journal ASA 112(6), 2002.

In EP 1 545 154 A2, measurements from loudspeakers to the listener are used in order to determine the inverse filters. This approach, however, suffers from a narrow sweet spot and unwanted coloration due to regularization. Since all frequencies are treated equally in the optimization stage, low and high frequency components are prone to errors due to the ill-conditioning.

In M. R. Bai, G. Y. Shih, C. C. Lee "Comparative study of audio spatializers for dual-loudspeaker mobile phones", Journal ASA 121(1), 2007, a sub-band division is used in order to lower the complexity of the inverse filter design. In this approach, a quadrature mirror filter (QMF) filter-bank is used in order to implement cross-talk reduction in a multi-rate manner. However, all frequencies are treated equally and the sub-band division is only used to lower the complexity. As a result, high regularization values are applied, resulting in a lowered spatial perception and sound quality.

In US 2013/0163766 A1, a sub-band analysis is employed in order to optimize the choice of regularization values. Because low and high frequency components use large regularization values, spatial perception and sound quality are affected by this approach.

SUMMARY

It is an object of the disclosure to provide an efficient concept for filtering a left channel input audio signal and a right channel input audio signal.

An object is achieved by the features of the independent claims. Further implementation forms are apparent from the dependent claims, the description and the figures.

The disclosure is based on the finding that the left channel input audio signal and the right channel input audio signal can be decomposed into a plurality of predetermined frequency bands, wherein each predetermined frequency band is chosen to increase the accuracy of relevant binaural cues, such as inter-aural time differences (ITDs) and inter-aural level differences (ILDs), within each predetermined frequency band and to minimize complexity.

Each predetermined frequency band can be chosen such that robustness can be provided and undesired coloration can be avoided. At low frequencies, e.g. below 1.6 kHz, cross-talk reduction can be performed using simple time delays and gains. This way, accurate inter-aural time differences (ITDs) can be rendered while high sound quality can be preserved. For middle frequencies, e.g. between 1.6 kHz and 6 kHz, a cross-talk reduction can be performed for accurately reproducing inter-aural level differences (ILDs) between the audio signals. Very low frequency components, e.g. below 200 Hz, and high frequency components, e.g. above 6 kHz, can be delayed and/or bypassed in order to avoid harmonic distortions and undesired coloration. For frequencies below 1.6 kHz, sound localization can be dominated by inter-aural time differences (ITDs). Above this frequency, the effect of inter-aural level differences (ILDs) can increase systematically with frequency, making it a dominant cue at high frequencies.

According to a first aspect, the disclosure relates to an audio signal processing apparatus for filtering a left channel input audio signal to obtain a left channel output audio signal and for filtering a right channel input audio signal to obtain a right channel output audio signal, the left channel output audio signal and the right channel output audio signal to be transmitted over acoustic propagation paths to a listener, wherein transfer functions of the acoustic propagation paths are defined by an acoustic transfer function matrix, the audio signal processing apparatus comprising a decomposer being configured to decompose the left channel input audio signal into a first left channel input audio sub-signal and a second left channel input audio sub-signal, and to decompose the right channel input audio signal into a first right channel input audio sub-signal and a second right channel input audio sub-signal, wherein the first left channel input audio sub-signal and the first right channel input audio sub-signal are allocated to a first predetermined frequency band, and wherein the second left channel input audio sub-signal and the second right channel input audio sub-signal are allocated to a second predetermined frequency band, a first cross-talk reducer being configured to reduce a cross-talk between the first left channel input audio sub-signal and the first right channel input audio sub-signal within the first predetermined frequency band upon the basis of the acoustic transfer function matrix to obtain a first left channel output audio sub-signal and a first right channel output audio sub-signal, a second cross-talk reducer being configured to reduce a cross-talk between the second left channel input audio sub-signal and the second right channel input audio sub-signal within the second predetermined frequency band upon the basis of the acoustic transfer function matrix to obtain a second left channel output audio sub-signal and a second right channel output audio sub-signal, and a combiner being configured to combine the first left channel output audio sub-signal and the second left channel output audio sub-signal to obtain the left channel output audio signal, and to combine the first right channel output audio sub-signal and the second right channel output audio sub-signal to obtain the right channel output audio signal. Thus, an efficient concept for filtering a left channel input audio signal and a right channel input audio signal is realized.

The audio signal processing apparatus can perform a cross-talk reduction between the left channel input audio signal and the right channel input audio signal. The first predetermined frequency band can comprise low frequency components. The second predetermined frequency band can comprise middle frequency components.

In a first implementation form of the audio signal processing apparatus according to the first aspect as such, the left channel output audio signal is to be transmitted over a first acoustic propagation path between a left loudspeaker and a left ear of the listener and a second acoustic propagation path between the left loudspeaker and a right ear of the listener, wherein the right channel output audio signal is to be transmitted over a third acoustic propagation path between a right loudspeaker and the right ear of the listener and a fourth acoustic propagation path between the right loudspeaker and the left ear of the listener, and wherein a first transfer function of the first acoustic propagation path, a second transfer function of the second acoustic propagation path, a third transfer function of the third acoustic propagation path, and a fourth transfer function of the fourth acoustic propagation path form the acoustic transfer function matrix. Thus, the acoustic transfer function matrix is provided upon the basis of an arrangement of the left loudspeaker and the right loudspeaker with regard to the listener.

In a second implementation form of the audio signal processing apparatus according to the first aspect as such or any preceding implementation form of the first aspect, the first cross-talk reducer is configured to determine a first cross-talk reduction matrix upon the basis of the acoustic transfer function matrix, and to filter the first left channel input audio sub-signal and the first right channel input audio sub-signal upon the basis of the first cross-talk reduction matrix. Thus, a cross-talk reduction by the first cross-talk reducer is performed efficiently.

In a third implementation form of the audio signal processing apparatus according to the second implementation form of the first aspect, elements of the first cross-talk reduction matrix indicate gains and time delays associated with the first left channel input audio sub-signal and the first right channel input audio sub-signal, wherein the gains and the time delays are constant within the first predetermined frequency band. Thus, inter-aural time differences (ITDs) can be rendered efficiently.

In a fourth implementation form of the audio signal processing apparatus according to the third implementation form of the first aspect, the first cross-talk reducer is configured to determine the first cross-talk reduction matrix according to the following equations:

$$C_{S1} = \begin{bmatrix} A_{11}z^{-d_{11}} & A_{12}z^{-d_{12}} \\ A_{21}z^{-d_{21}} & A_{22}z^{-d_{22}} \end{bmatrix}$$

$$A_{ij} = \max\{|C_{ij}|\} \cdot \mathrm{sign}(C_{ijmax})$$

$$C = (H^H H + \beta(\omega)I)^{-1} H^H e^{-j\omega M}$$

wherein $C_{S1}$ denotes the first cross-talk reduction matrix, $A_{ij}$ denotes the gains, $d_{ij}$ denotes the time delays, C denotes a generic cross-talk reduction matrix, $C_{ij}$ denotes elements of the generic cross-talk reduction matrix, $C_{ijmax}$ denotes a maximum value of the elements $C_{ij}$ of the generic cross-talk reduction matrix, H denotes the acoustic transfer function matrix, I denotes an identity matrix, β denotes a regularization factor, M denotes a modelling delay, and ω denotes an angular frequency. Thus, the first cross-talk reduction matrix is determined upon the basis of a least-mean squares cross-talk reduction approach having constant gains and time delays within the first predetermined frequency band.

In a fifth implementation form of the audio signal processing apparatus according to the first aspect as such or any preceding implementation form of the first aspect, the second cross-talk reducer is configured to determine a second cross-talk reduction matrix upon the basis of the acoustic transfer function matrix, and to filter the second left channel input audio sub-signal and the second right channel input audio sub-signal upon the basis of the second cross-talk reduction matrix. Thus, a cross-talk reduction by the second cross-talk reducer is performed efficiently.

In a sixth implementation form of the audio signal processing apparatus according to the fifth implementation form of the first aspect, the second cross-talk reducer is configured to determine the second cross-talk reduction matrix according to the following equation:

$$C_{S2} = BP(H^H H + \beta(\omega)I)^{-1} H^H e^{-j\omega M}$$

wherein $C_{S2}$ denotes the second cross-talk reduction matrix, H denotes the acoustic transfer function matrix, I denotes an identity matrix, BP denotes a band-pass filter, β denotes a regularization factor, M denotes a modelling delay, and ω denotes an angular frequency. Thus, the second cross-talk reduction matrix is determined upon the basis of a least-mean squares cross-talk reduction approach. The band-pass filtering can be performed within the second predetermined frequency band.

In a seventh implementation form of the audio signal processing apparatus according to the first aspect as such or any preceding implementation form of the first aspect, the audio signal processing apparatus further comprises a delayer being configured to delay a third left channel input audio sub-signal within a third predetermined frequency band by a time delay to obtain a third left channel output audio sub-signal, and to delay a third right channel input audio sub-signal within the third predetermined frequency band by a further time delay to obtain a third right channel output audio sub-signal, wherein the decomposer is configured to decompose the left channel input audio signal into the first left channel input audio sub-signal, the second left channel input audio sub-signal, and the third left channel input audio sub-signal, and to decompose the right channel input audio signal into the first right channel input audio sub-signal, the second right channel input audio sub-signal, and the third right channel input audio sub-signal, wherein the third left channel input audio sub-signal and the third right channel input audio sub-signal are allocated to the third predetermined frequency band, and wherein the combiner is configured to combine the first left channel output audio sub-signal, the second left channel output audio sub-signal, and the third left channel output audio sub-signal to obtain the left channel output audio signal, and to combine the first right channel output audio sub-signal, the second right channel output audio sub-signal, and the third right channel output audio sub-signal to obtain the right channel output audio signal. Thus, a bypass within the third predetermined frequency band is realized. The third predetermined frequency band can comprise very low frequency components.

In an eighth implementation form of the audio signal processing apparatus according to the seventh implementation form of the first aspect, the audio signal processing apparatus further comprises a further delayer being configured to delay a fourth left channel input audio sub-signal within a fourth predetermined frequency band by the time delay to obtain a fourth left channel output audio sub-signal, and to delay a fourth right channel input audio sub-signal within the fourth predetermined frequency band by the further time delay to obtain a fourth right channel output audio sub-signal, wherein the decomposer is configured to decompose the left channel input audio signal into the first left channel input audio sub-signal, the second left channel input audio sub-signal, the third left channel input audio sub-signal, and the fourth left channel input audio sub-signal, and to decompose the right channel input audio signal into the first right channel input audio sub-signal, the second right channel input audio sub-signal, the third right channel input audio sub-signal, and the fourth right channel input audio sub-signal, wherein the fourth left channel input audio sub-signal and the fourth right channel input audio sub-signal are allocated to the fourth predetermined frequency band, and wherein the combiner is configured to combine the first left channel output audio sub-signal, the second left channel output audio sub-signal, the third left channel output audio sub-signal, and the fourth left channel output audio sub-signal to obtain the left channel output audio signal, and to combine the first right channel output audio sub-signal, the second right channel output audio sub-signal, the third right channel output audio sub-signal, and the fourth right channel output audio sub-signal to obtain the right channel output audio signal. Thus, a bypass within the fourth predetermined frequency band is realized. The fourth predetermined frequency band can comprise high frequency components.

In a ninth implementation form of the audio signal processing apparatus according to the first aspect as such or any preceding implementation form of the first aspect, the decomposer is an audio crossover network. Thus, the decomposition of the left channel input audio signal and the right channel input audio signal is realized efficiently.

The audio crossover network can be an analog audio crossover network or a digital audio crossover network. The decomposition can be realized upon the basis of a band-pass filtering of the left channel input audio signal and the right channel input audio signal.

In a tenth implementation form of the audio signal processing apparatus according to the first aspect as such or any preceding implementation form of the first aspect, the combiner is configured to add the first left channel output audio sub-signal and the second left channel output audio sub-signal to obtain the left channel output audio signal, and to add the first right channel output audio sub-signal and the second right channel output audio sub-signal to obtain the right channel output audio signal. Thus, a superposition by the combiner is realized efficiently.

The combiner can further be configured to add the third left channel output audio sub-signal and/or the fourth left channel output audio sub-signal to the first left channel output audio sub-signal and the second left channel output audio sub-signal to obtain the left channel output audio signal. The combiner can further be configured to add the third right channel output audio sub-signal and/or the fourth right channel output audio sub-signal to the first right channel output audio sub-signal and the second right channel output audio sub-signal to obtain the right channel output audio signal.

In an eleventh implementation form of the audio signal processing apparatus according to the first aspect as such or any preceding implementation form of the first aspect, the left channel input audio signal is formed by a front left channel input audio signal of a multi-channel input audio signal and the right channel input audio signal is formed by a front right channel input audio signal of the multi-channel input audio signal, or the left channel input audio signal is formed by a back left channel input audio signal of a multi-channel input audio signal and the right channel input audio signal is formed by a back right channel input audio signal of the multi-channel input audio signal. Thus, a multi-channel input audio signal can be processed by the audio signal processing apparatus efficiently.

The first cross-talk reducer and/or the second cross-talk reducer can consider an arrangement of virtual loudspeakers with regard to the listener using a modified least-squares cross-talk reduction approach.

In a twelfth implementation form of the audio signal processing apparatus according to the eleventh implementation form of the first aspect, the multi-channel input audio signal comprises a center channel input audio signal, wherein the combiner is configured to combine the center channel input audio signal, the first left channel output audio sub-signal, and the second left channel output audio sub-signal to obtain the left channel output audio signal, and to combine the center channel input audio signal, the first right channel output audio sub-signal, and the second right channel output audio sub-signal to obtain the right channel output audio signal. Thus, a combination with an un-modified center channel input audio signal is realized efficiently.

The center channel input audio signal can further be combined with the third left channel output audio sub-signal, the fourth left channel output audio sub-signal, the third right channel output audio sub-signal, and/or the fourth right channel output audio sub-signal.

In a thirteenth implementation form of the audio signal processing apparatus according to the first aspect as such or any preceding implementation form of the first aspect, the audio signal processing apparatus further comprises a memory being configured to store the acoustic transfer function matrix, and to provide the acoustic transfer function matrix to the first cross-talk reducer and the second cross-talk reducer. Thus, the acoustic transfer function matrix can be provided efficiently.

The acoustic transfer function matrix can be determined based on measurements, generic head-related transfer functions, or a head-related transfer-function model.

According to a second aspect, the disclosure relates to an audio signal processing method for filtering a left channel input audio signal to obtain a left channel output audio signal and for filtering a right channel input audio signal to obtain a right channel output audio signal, the left channel output audio signal and the right channel output audio signal to be transmitted over acoustic propagation paths to a listener, wherein transfer functions of the acoustic propagation paths are defined by an acoustic transfer function matrix, the audio signal processing method comprising decomposing, by a decomposer, the left channel input audio signal into a first left channel input audio sub-signal and a second left channel input audio sub-signal, decomposing, by the decomposer, the right channel input audio signal into a first right channel input audio sub-signal and a second right channel input audio sub-signal, wherein the first left channel input audio sub-signal and the first right channel input audio sub-signal are allocated to a first predetermined frequency band, and wherein the second left channel input audio sub-signal and the second right channel input audio sub-signal are allocated to a second predetermined frequency band, reducing a cross-talk, by a first cross-talk reducer, between the first left channel input audio sub-signal and the first right channel input audio sub-signal within the first predetermined frequency band upon the basis of the acoustic transfer function matrix to obtain a first left channel output audio sub-signal and a first right channel output audio sub-signal, reducing a cross-talk, by a second cross-talk reducer, between the second left channel input audio sub-signal and the second right channel input audio sub-signal within the second predetermined frequency band upon the basis of the acoustic transfer function matrix to obtain a second left channel output audio sub-signal and a second right channel output audio sub-signal, combining, by a combiner, the first left channel output audio sub-signal and the second left channel output audio sub-signal to obtain the left channel output audio signal, and combining, by the combiner, the first right channel output audio sub-signal and the second right channel output audio sub-signal to obtain the right channel output audio signal. Thus, an efficient concept for filtering a left channel input audio signal and a right channel input audio signal is realized.

The audio signal processing method can be performed by the audio signal processing apparatus. Further features of the audio signal processing method directly result from the functionality of the audio signal processing apparatus.

In a first implementation form of the audio signal processing method according to the second aspect as such, the left channel output audio signal is to be transmitted over a first acoustic propagation path between a left loudspeaker and a left ear of the listener and a second acoustic propagation path between the left loudspeaker and a right ear of the listener, wherein the right channel output audio signal is to be transmitted over a third acoustic propagation path between a right loudspeaker and the right ear of the listener and a fourth acoustic propagation path between the right loudspeaker and the left ear of the listener, and wherein a first transfer function of the first acoustic propagation path, a second transfer function of the second acoustic propagation path, a third transfer function of the third acoustic propagation path, and a fourth transfer function of the fourth acoustic propagation path form the acoustic transfer function matrix. Thus, the acoustic transfer function matrix is provided upon the basis of an arrangement of the left loudspeaker and the right loudspeaker with regard to the listener.

In a second implementation form of the audio signal processing method according to the second aspect as such or any preceding implementation form of the second aspect, the audio signal processing method further comprises determining, by the first cross-talk reducer, a first cross-talk reduction matrix upon the basis of the acoustic transfer function matrix, and filtering, by the first cross-talk reducer, the first left channel input audio sub-signal and the first right channel input audio sub-signal upon the basis of the first cross-talk reduction matrix. Thus, a cross-talk reduction by the first cross-talk reducer is performed efficiently.

In a third implementation form of the audio signal processing method according to the second implementation form of the second aspect, elements of the first cross-talk reduction matrix indicate gains and time delays associated with the first left channel input audio sub-signal and the first right channel input audio sub-signal, wherein the gains and the time delays are constant within the first predetermined frequency band. Thus, inter-aural time differences (ITDs) can be rendered efficiently.

In a fourth implementation form of the audio signal processing method according to the third implementation form of the second aspect, the audio signal processing method further comprises determining, by the first cross-talk reducer, the first cross-talk reduction matrix according to the following equations:

$$C_{S1} = \begin{bmatrix} A_{11}z^{-d_{11}} & A_{12}z^{-d_{12}} \\ A_{21}z^{-d_{21}} & A_{22}z^{-d_{22}} \end{bmatrix}$$

$$A_{ij} = \max\{|C_{ij}|\} \cdot \mathrm{sign}(C_{ijmax})$$

$$C = (H^H H + \beta(\omega)I)^{-1} H^H e^{-j\omega M}$$

wherein $C_{S1}$ denotes the first cross-talk reduction matrix, $A_{ij}$ denotes the gains, $d_{ij}$ denotes the time delays, C denotes a generic cross-talk reduction matrix, $C_{ij}$ denotes elements of the generic cross-talk reduction matrix, $C_{ijmax}$ denotes a maximum value of the elements $C_{ij}$ of the generic cross-talk reduction matrix, H denotes the acoustic transfer function matrix, I denotes an identity matrix, β denotes a regularization factor, M denotes a modelling delay, and ω denotes an angular frequency. Thus, the first cross-talk reduction matrix is determined upon the basis of a least-mean squares cross-talk reduction approach having constant gains and time delays within the first predetermined frequency band.

In a fifth implementation form of the audio signal processing method according to the second aspect as such or any preceding implementation form of the second aspect, the audio signal processing method further comprises determining, by the second cross-talk reducer, a second cross-talk reduction matrix upon the basis of the acoustic transfer function matrix, and filtering, by the second cross-talk reducer, the second left channel input audio sub-signal and the second right channel input audio sub-signal upon the basis of the second cross-talk reduction matrix. Thus, a cross-talk reduction by the second cross-talk reducer is performed efficiently.

In a sixth implementation form of the audio signal processing method according to the fifth implementation form of the second aspect, the audio signal processing method further comprises determining, by the second cross-talk reducer, the second cross-talk reduction matrix according to the following equation:

$$C_{S2} = BP(H^H H + \beta(\omega)I)^{-1} H^H e^{-j\omega M}$$

wherein $C_{S2}$ denotes the second cross-talk reduction matrix, H denotes the acoustic transfer function matrix, I denotes an identity matrix, BP denotes a band-pass filter, β denotes a regularization factor, M denotes a modelling delay, and ω denotes an angular frequency. Thus, the second cross-talk reduction matrix is determined upon the basis of a least-mean squares cross-talk reduction approach. The band-pass filtering can be performed within the second predetermined frequency band.

In a seventh implementation form of the audio signal processing method according to the second aspect as such or any preceding implementation form of the second aspect, the audio signal processing method further comprises delaying, by a delayer, a third left channel input audio sub-signal within a third predetermined frequency band by a time delay to obtain a third left channel output audio sub-signal, delaying, by the delayer, a third right channel input audio sub-signal within the third predetermined frequency band by a further time delay to obtain a third right channel output audio sub-signal, decomposing, by the decomposer, the left channel input audio signal into the first left channel input audio sub-signal, the second left channel input audio sub-signal, and the third left channel input audio sub-signal, decomposing, by the decomposer, the right channel input audio signal into the first right channel input audio sub-signal, the second right channel input audio sub-signal, and the third right channel input audio sub-signal, wherein the third left channel input audio sub-signal and the third right channel input audio sub-signal are allocated to the third predetermined frequency band, combining, by the combiner, the first left channel output audio sub-signal, the second left channel output audio sub-signal, and the third left channel output audio sub-signal to obtain the left channel output audio signal, and combining, by the combiner, the first right channel output audio sub-signal, the second right channel output audio sub-signal, and the third right channel output audio sub-signal to obtain the right channel output audio signal. Thus, a bypass within the third predetermined frequency band is realized. The third predetermined frequency band can comprise very low frequency components.

In an eighth implementation form of the audio signal processing method according to the seventh implementation form of the second aspect, the audio signal processing method further comprises delaying, by a further delayer, a fourth left channel input audio sub-signal within a fourth predetermined frequency band by the time delay to obtain a fourth left channel output audio sub-signal, delaying, by the further delayer, a fourth right channel input audio sub-signal within the fourth predetermined frequency band by the further time delay to obtain a fourth right channel output audio sub-signal, decomposing, by the decomposer, the left channel input audio signal into the first left channel input audio sub-signal, the second left channel input audio sub-signal, the third left channel input audio sub-signal, and the fourth left channel input audio sub-signal, decomposing, by the decomposer, the right channel input audio signal into the first right channel input audio sub-signal, the second right channel input audio sub-signal, the third right channel input audio sub-signal, and the fourth right channel input audio sub-signal, wherein the fourth left channel input audio sub-signal and the fourth right channel input audio sub-signal are allocated to the fourth predetermined frequency band, combining, by the combiner, the first left channel output audio sub-signal, the second left channel output audio sub-signal, the third left channel output audio sub-signal, and the fourth left channel output audio sub-signal to obtain the left channel output audio signal, and combining, by the combiner, the first right channel output audio sub-signal, the second right channel output audio sub-signal, the third right channel output audio sub-signal, and the fourth right channel output audio sub-signal to obtain the right channel output audio signal. Thus, a bypass within the fourth predetermined frequency band is realized. The fourth predetermined frequency band can comprise high frequency components.

In a ninth implementation form of the audio signal processing method according to the second aspect as such or any preceding implementation form of the second aspect, the decomposer is an audio crossover network. Thus, the decomposition of the left channel input audio signal and the right channel input audio signal is realized efficiently.

In a tenth implementation form of the audio signal processing method according to the second aspect as such or any preceding implementation form of the second aspect, the audio signal processing method further comprises adding, by the combiner, the first left channel output audio sub-signal and the second left channel output audio sub-signal to obtain the left channel output audio signal, and adding, by the combiner, the first right channel output audio sub-signal and the second right channel output audio sub-signal to obtain the right channel output audio signal. Thus, a superposition by the combiner is realized efficiently.

The audio signal processing method can further comprise adding, by the combiner, the third left channel output audio sub-signal and/or the fourth left channel output audio sub-signal to the first left channel output audio sub-signal and the second left channel output audio sub-signal to obtain the left channel output audio signal. The audio signal processing method can further comprise adding, by the combiner, the third right channel output audio sub-signal and/or the fourth right channel output audio sub-signal to the first right channel output audio sub-signal and the second right channel output audio sub-signal to obtain the right channel output audio signal.

In an eleventh implementation form of the audio signal processing method according to the second aspect as such or any preceding implementation form of the second aspect, the left channel input audio signal is formed by a front left channel input audio signal of a multi-channel input audio signal and the right channel input audio signal is formed by a front right channel input audio signal of the multi-channel input audio signal, or the left channel input audio signal is formed by a back left channel input audio signal of a multi-channel input audio signal and the right channel input audio signal is formed by a back right channel input audio signal of the multi-channel input audio signal. Thus, a multi-channel input audio signal can be processed by the audio signal processing method efficiently.

In a twelfth implementation form of the audio signal processing method according to the eleventh implementation form of the second aspect, the multi-channel input audio signal comprises a center channel input audio signal, wherein the audio signal processing method further comprises combining, by the combiner, the center channel input audio signal, the first left channel output audio sub-signal, and the second left channel output audio sub-signal to obtain the left channel output audio signal, and combining, by the combiner, the center channel input audio signal, the first right channel output audio sub-signal, and the second right channel output audio sub-signal to obtain the right channel output audio signal. Thus, a combination with an un-modified center channel input audio signal is realized efficiently.

The audio signal processing method can further comprise combining, by the combiner, the center channel input audio signal with the third left channel output audio sub-signal, the fourth left channel output audio sub-signal, the third right channel output audio sub-signal, and/or the fourth right channel output audio sub-signal.

In a thirteenth implementation form of the audio signal processing method according to the second aspect as such or any preceding implementation form of the second aspect, the audio signal processing method further comprises storing, by a memory, the acoustic transfer function matrix, and providing, by the memory, the acoustic transfer function matrix to the first cross-talk reducer and the second cross-talk reducer. Thus, the acoustic transfer function matrix can be provided efficiently.

According to a third aspect, the disclosure relates to a computer program comprising a program code for performing the audio signal processing method when executed on a computer. Thus, the audio signal processing method can be performed in an automatic and repeatable manner. The audio signal processing apparatus can be programmably arranged to perform the computer program.

The disclosure can be implemented in hardware and/or software.

Embodiments of the disclosure will be described with respect to the following figures, in which.

DETAILED DESCRIPTION OF EMBODIMENTS

Figure 1:
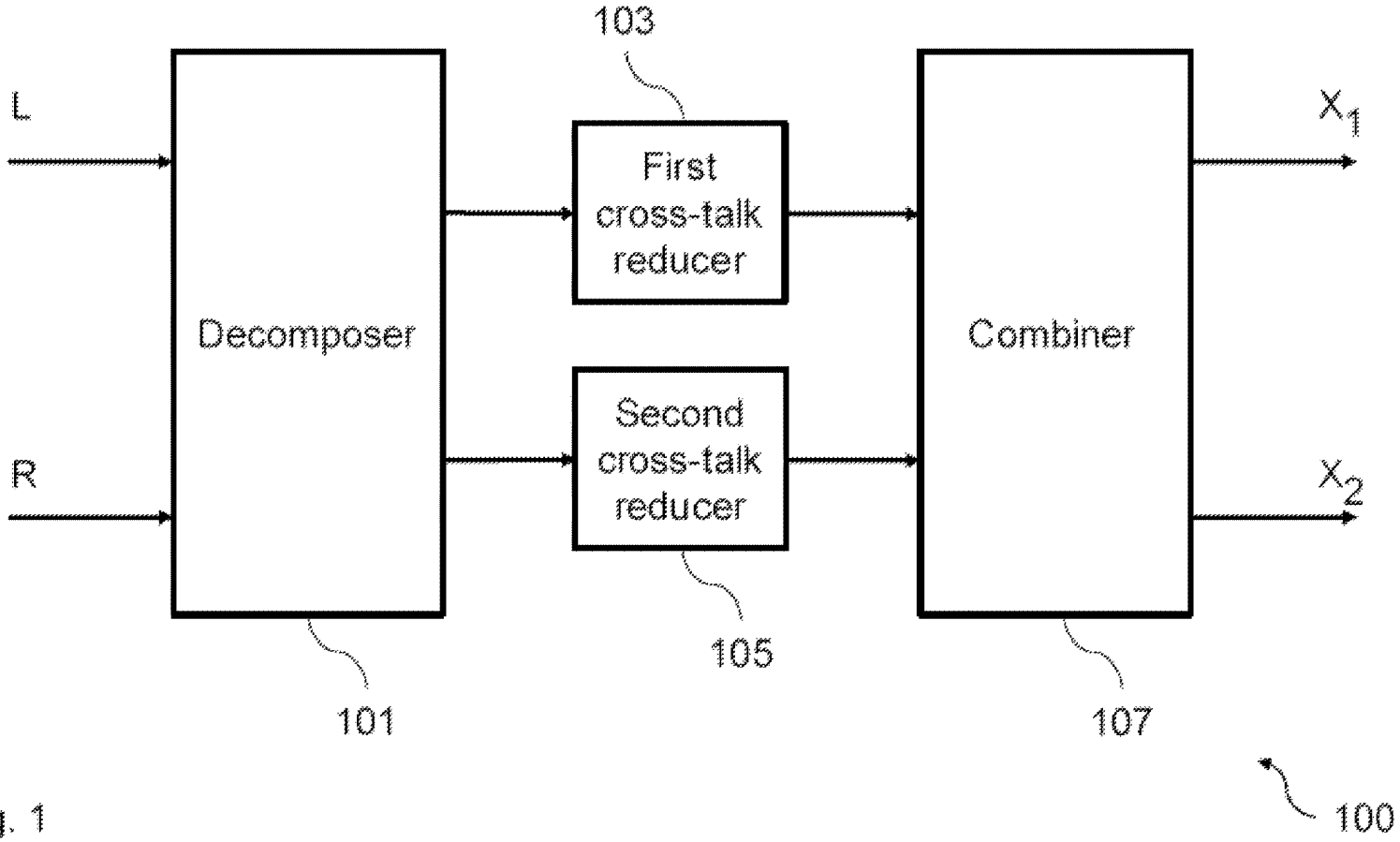
FIG. 1 shows a diagram of an audio signal processing apparatus for filtering a left channel input audio signal and a right channel input audio signal according to an embodiment.

FIG. 1 shows a diagram of an audio signal processing apparatus 100 according to an embodiment. The audio signal processing apparatus 100 is adapted to filter a left channel input audio signal L to obtain a left channel output audio signal $X_1$ and to filter a right channel input audio signal R to obtain a right channel output audio signal $X_2$.

The left channel output audio signal $X_1$ and the right channel output audio signal $X_2$ are to be transmitted over acoustic propagation paths to a listener, wherein transfer functions of the acoustic propagation paths are defined by an acoustic transfer function (ATF) matrix H.

The audio signal processing apparatus 100 comprises a decomposer 101 being configured to decompose the left channel input audio signal L into a first left channel input audio sub-signal and a second left channel input audio sub-signal, and to decompose the right channel input audio signal R into a first right channel input audio sub-signal and a second right channel input audio sub-signal, wherein the first left channel input audio sub-signal and the first right channel input audio sub-signal are allocated to a first predetermined frequency band, and wherein the second left channel input audio sub-signal and the second right channel input audio sub-signal are allocated to a second predetermined frequency band, a first cross-talk reducer 103 being configured to reduce a cross-talk between the first left channel input audio sub-signal and the first right channel input audio sub-signal within the first predetermined frequency band upon the basis of the ATF matrix H to obtain a first left channel output audio sub-signal and a first right channel output audio sub-signal, a second cross-talk reducer 105 being configured to reduce a cross-talk between the second left channel input audio sub-signal and the second right channel input audio sub-signal within the second predetermined frequency band upon the basis of the ATF matrix H to obtain a second left channel output audio sub-signal and a second right channel output audio sub-signal, and a combiner 107 being configured to combine the first left channel output audio sub-signal and the second left channel output audio sub-signal to obtain the left channel output audio signal $X_1$, and to combine the first right channel output audio sub-signal and the second right channel output audio sub-signal to obtain the right channel output audio signal $X_2$.

Figure 2:
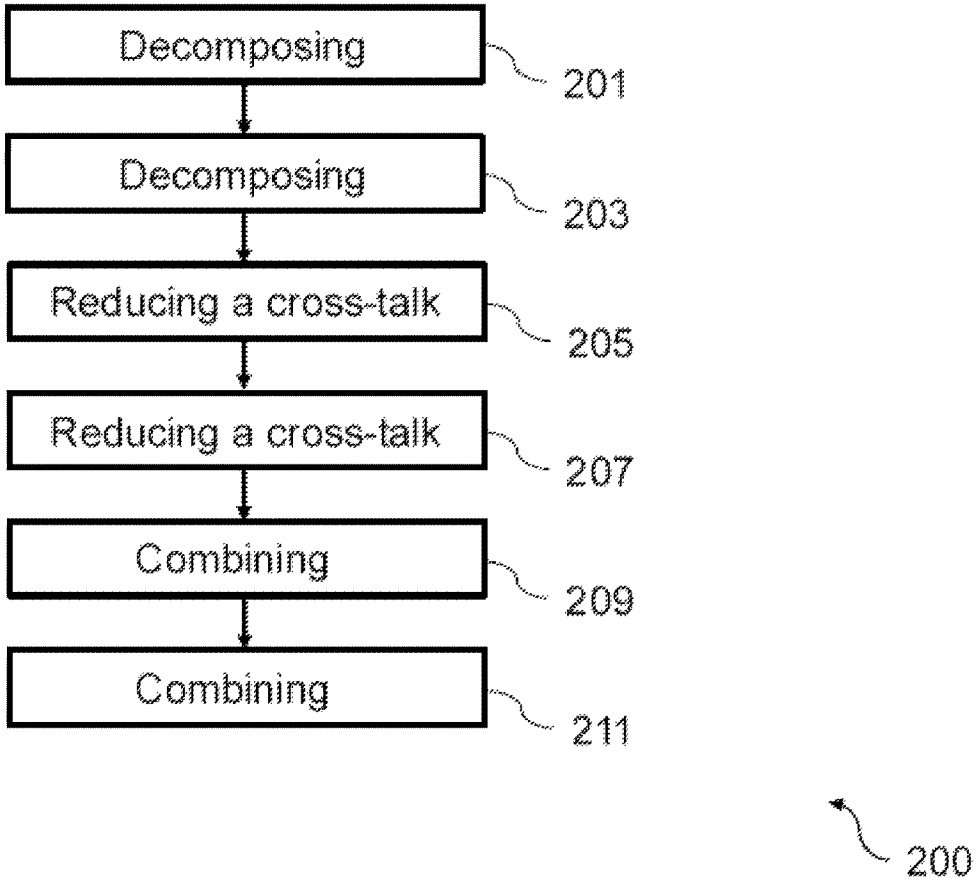
FIG. 2 shows a diagram of an audio signal processing method for filtering a left channel input audio signal and a right channel input audio signal according to an embodiment.

FIG. 2 shows a diagram of an audio signal processing method 200 according to an embodiment. The audio signal processing method 200 is adapted to filter a left channel input audio signal L to obtain a left channel output audio signal $X_1$ and to filter a right channel input audio signal R to obtain a right channel output audio signal $X_2$.

The left channel output audio signal $X_1$ and the right channel output audio signal $X_2$ are to be transmitted over acoustic propagation paths to a listener, wherein transfer functions of the acoustic propagation paths are defined by an ATF matrix H.

The audio signal processing method 200 comprises decomposing 201 the left channel input audio signal L into a first left channel input audio sub-signal and a second left channel input audio sub-signal, decomposing 203 the right channel input audio signal R into a first right channel input audio sub-signal and a second right channel input audio sub-signal, wherein the first left channel input audio sub-signal and the first right channel input audio sub-signal are allocated to a first predetermined frequency band, and wherein the second left channel input audio sub-signal and the second right channel input audio sub-signal are allocated to a second predetermined frequency band, reducing 205 a cross-talk between the first left channel input audio sub-signal and the first right channel input audio sub-signal within the first predetermined frequency band upon the basis of the ATF matrix H to obtain a first left channel output audio sub-signal and a first right channel output audio sub-signal, reducing 207 a cross-talk between the second left channel input audio sub-signal and the second right channel input audio sub-signal within the second predetermined frequency band upon the basis of the ATF matrix H to obtain a second left channel output audio sub-signal and a second right channel output audio sub-signal, combining 209 the first left channel output audio sub-signal and the second left channel output audio sub-signal to obtain the left channel output audio signal $X_1$, and combining 211 the first right channel output audio sub-signal and the second right channel output audio sub-signal to obtain the right channel output audio signal $X_2$.

One skilled in the art appreciates that the above steps can be performed serially, in parallel, or a combination thereof. For example, steps 201 and 203 can be performed in parallel to each other and in series vis-à-vis respective steps 205 and 207.

In the following, further implementation forms and embodiments of the audio signal processing apparatus 100 and the audio signal processing method 200 are described.

The audio signal processing apparatus 100 and the audio signal processing method 200 can be applied for a perceptually optimized cross-talk reduction using a sub-band analysis.

The concept relates to the field of audio signal processing, in particular to audio signal processing using at least two loudspeakers or transducers in order to provide an increased spatial (e.g. stereo widening) or virtual surround audio effect for a listener.

Figure 3:
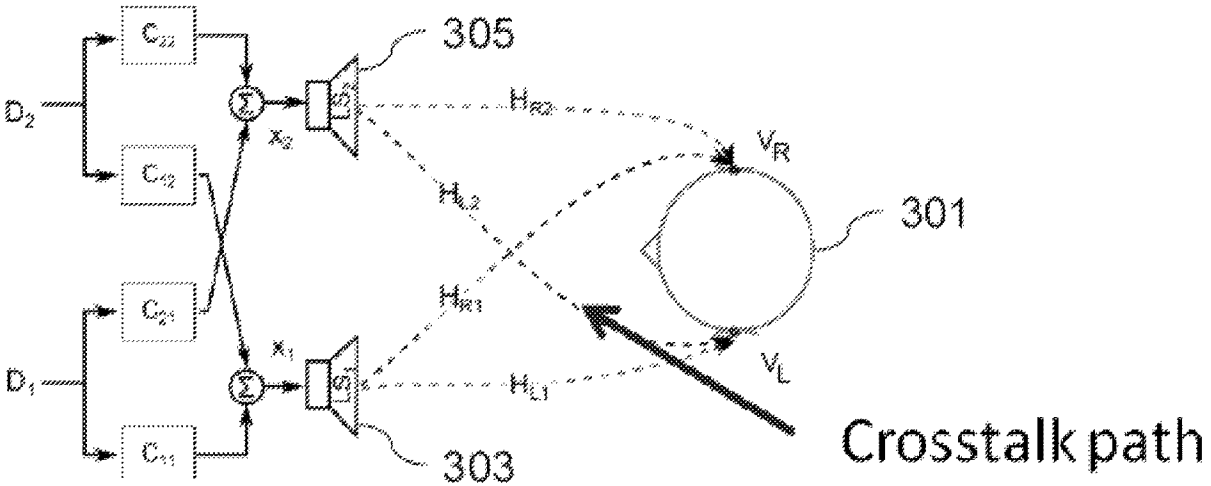
FIG. 3 shows a diagram of a generic cross-talk reduction scenario comprising a left loudspeaker, a right loudspeaker, and a listener.

FIG. 3 shows a diagram of a generic cross-talk reduction scenario. The diagram illustrates a general scheme of cross-talk reduction or cross-talk cancellation. In this scenario, a left channel input audio signal $D_1$ is filtered to obtain a left channel output audio signal $X_1$, and a right channel input audio signal $D_2$ is filtered to obtain a right channel output audio signal $X_2$ upon the basis of elements $C_{ij}$.

The left channel output audio signal $X_1$ is to be transmitted via a left loudspeaker 303 over acoustic propagation paths to a listener 301, and the right channel output audio signal $X_2$ is to be transmitted via a right loudspeaker 305 over acoustic propagation paths to the listener 301. Transfer functions of the acoustic propagation paths are defined by an ATF matrix H.

The left channel output audio signal $X_1$ is to be transmitted over a first acoustic propagation path between the left loudspeaker 303 and a left ear of the listener 301 and a second acoustic propagation path between the left loudspeaker 303 and a right ear of the listener 301. The right channel output audio signal $X_2$ is to be transmitted over a third acoustic propagation path between the right loudspeaker 305 and the right ear of the listener 301 and a fourth acoustic propagation path between the right loudspeaker 305 and the left ear of the listener 301. A first transfer function $H_{L1}$ of the first acoustic propagation path, a second transfer function $H_{R1}$ of the second acoustic propagation path, a third transfer function $H_{R2}$ of the third acoustic propagation path, and a fourth transfer function $H_{L2}$ of the fourth acoustic propagation path form the ATF matrix H. The listener 301 perceives a left ear audio signal $V_L$ at the left ear, and a right ear audio signal $V_R$ at the right ear.

When reproducing e.g. binaural audio signals through the loudspeakers 303, 305, the audio signals that are to be heard in one ear of the listener 301 are also heard in the other ear. This effect is denoted as cross-talk and it is possible to reduce it by e.g. adding an inverse filter into the reproduction chain. These techniques are also denoted as cross-talk cancellation.

Ideal cross-talk reduction can be achieved if the audio signals at the ears $V_i$ are the same as the input audio signals $D_i$, i.e.

$$\underbrace{\begin{bmatrix} H_{L1} & H_{L2} \\ H_{R1} & H_{R2} \end{bmatrix}}_{H} \cdot \underbrace{\begin{bmatrix} C_{11} & C_{12} \\ C_{21} & C_{22} \end{bmatrix}}_{C} \approx \underbrace{\begin{bmatrix} 1 & 0 \\ 0 & 1 \end{bmatrix}}_{I} \tag{1}$$

wherein H denotes the ATF matrix comprising the transfer functions from the loudspeakers 303, 305 to the ears of the listener 301, C denotes a cross-talk reduction filter matrix comprising the cross-talk reduction filters, and I denotes an identity matrix.

An exact solution does usually not exist and optimal inverse filters can be found by minimizing a cost function based on equation (1). The result of a typical cross-talk reduction optimization using a least squares approximation is:

$$C=(H^H H+\beta(\omega)I)^{-1}H^H e^{-j\omega M} \tag{2}$$

wherein β denotes a regularization factor, and M denotes a modeling delay. The regularization factor is usually employed in order to achieve stability and to constrain the gain of the filters. The larger the regularization factor, the smaller is the filter gain, but at the expenses of reproduction accuracy and sound quality. The regularization factor can be regarded as a controlled additive noise, which is introduced in order to achieve stability.

Because the ill-conditioning of the equation system can vary with frequency, this factor can be designed to be frequency dependent. For example, at low frequencies, e.g. below 1000 Hz depending on the span angle of the loudspeakers 303, 305, the gain of the resulting filters can be rather large. Thus, there can be an inherent loss of dynamic range and large regularization values may be employed in order to avoid overdriving the loudspeakers 303, 305. At high frequencies, e.g. above 6000 Hz, the acoustic propagation path between the loudspeakers 303, 305 and the ears can present notches and peaks which can be characteristic of head-related transfer functions (HRTFs). These notches can be inverted into large peaks, which can result in unwanted coloration, ringing artifacts and distortions. Additionally, individual differences between head-related transfer-functions (HRTFs) can become large, making it difficult to invert the equation system properly without introducing errors.

Figure 4:
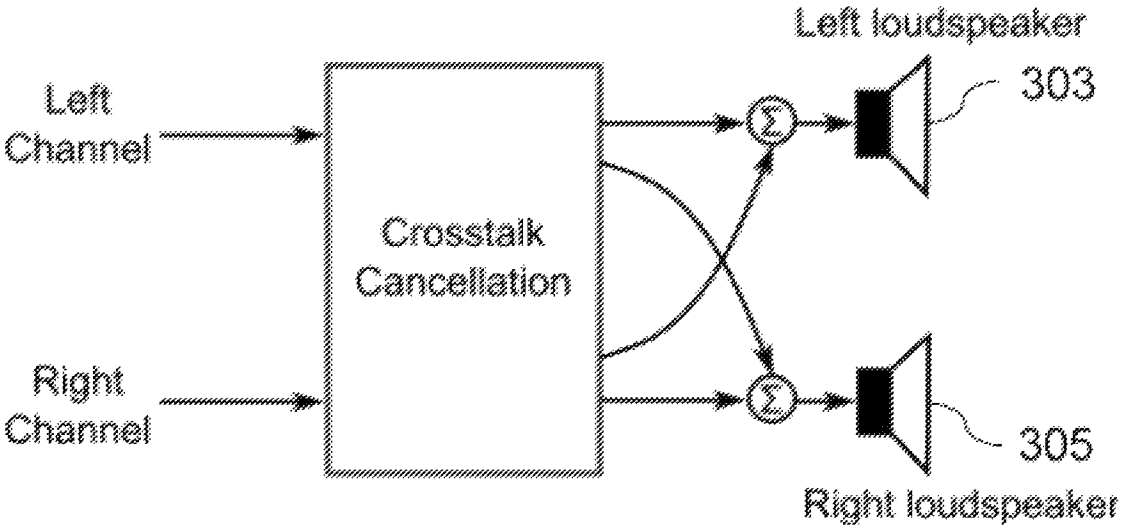
FIG. 4 shows a diagram of a generic cross-talk reduction scenario comprising a left loudspeaker, and a right loudspeaker.

FIG. 4 shows a diagram of a generic cross-talk reduction scenario. The diagram illustrates a general scheme of cross-talk reduction or cross-talk cancellation.

In order to generate a virtual sound effect with the left loudspeaker 303 and the right loudspeaker 305, the cross-talk between the contralateral loudspeakers and the ipsilateral ears is reduced or cancelled. This approach usually suffers from ill-conditioning, which results in inverse filters that are sensitive to errors. Large filter gains are also a result of the ill-conditioning of the equation system and regularization is usually applied.

Embodiments of the disclosure apply a cross-talk reduction design methodology in which the frequencies are divided into predetermined frequency bands and an optimal design principle for each predetermined frequency band is chose in order to maximize the accuracy of the relevant binaural cues, such as inter-aural time differences (ITDs) and inter-aural level differences (ILDs), and to minimize complexity.

Each predetermined frequency band is optimized so that the output is robust to errors and unwanted coloration is avoided. At low frequencies, e.g. below 1.6 kHz, cross-talk reduction filters can be approximated to be simple time delays and gains. This way, accurate inter-aural time differences (ITDs) can be rendered while sound quality is preserved. For middle frequencies, e.g. between 1.6 kHz and 6 kHz, a cross-talk reduction designed to reproduce accurate inter-aural level differences (ILDs), e.g. a conventional cross-talk reduction, can be used. Very low frequencies, e.g. below 200 Hz depending on the loudspeakers, and high frequencies, e.g. above 6 kHz, where individual differences become significant, can be delayed and/or bypassed in order to avoid harmonic distortions and undesired coloration.

Figure 5:
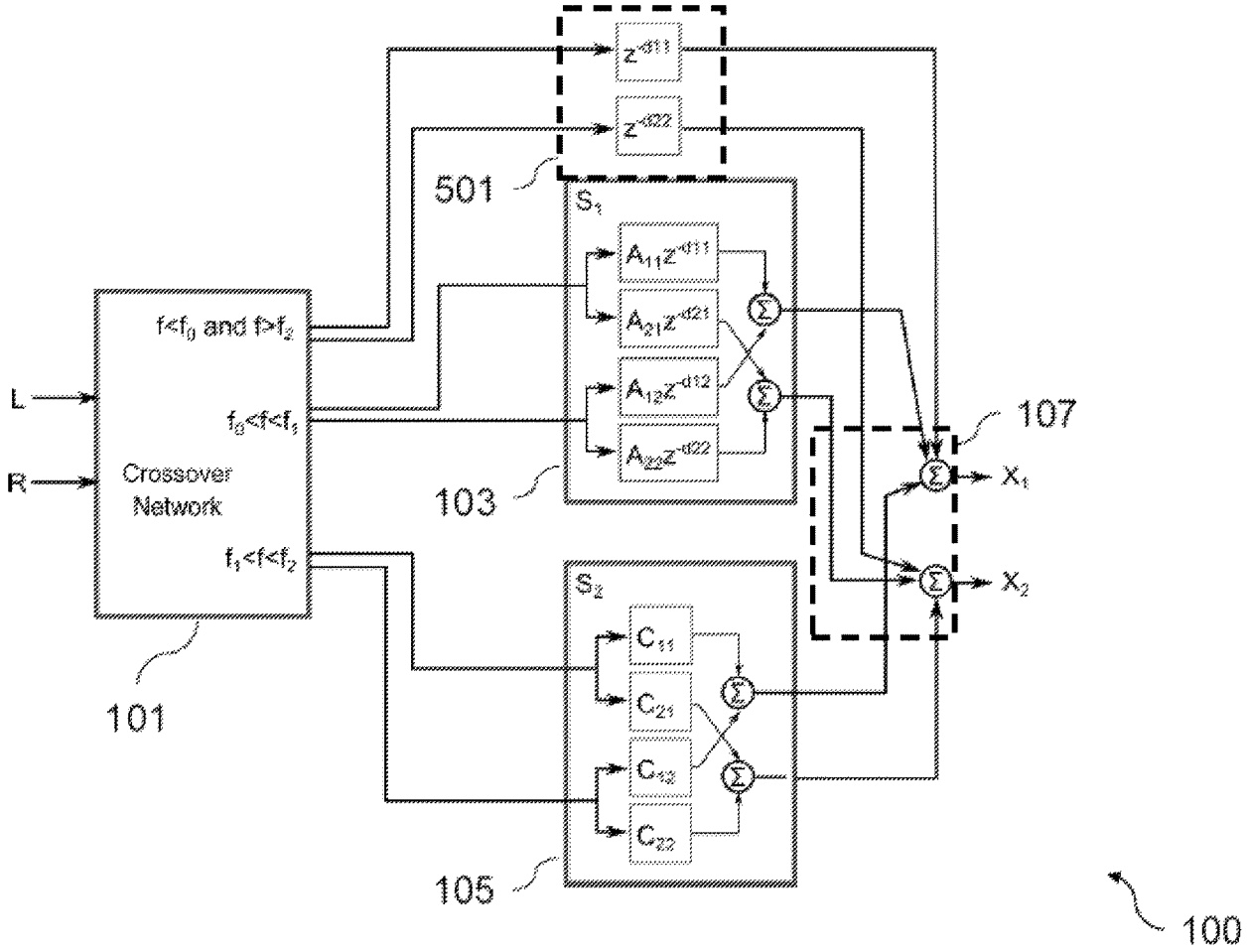
FIG. 5 shows a diagram of an audio signal processing apparatus for filtering a left channel input audio signal and a right channel input audio signal according to an embodiment.

FIG. 5 shows a diagram of an audio signal processing apparatus 100 according to an embodiment. The audio signal processing apparatus 100 is adapted to filter a left channel input audio signal L to obtain a left channel output audio signal $X_1$ and to filter a right channel input audio signal R to obtain a right channel output audio signal $X_2$.

The left channel output audio signal $X_1$ and the right channel output audio signal $X_2$ are to be transmitted over acoustic propagation paths to a listener, wherein transfer functions of the acoustic propagation paths are defined by an ATF matrix H.

The audio signal processing apparatus 100 comprises a decomposer 101 being configured to decompose the left channel input audio signal L into a first left channel input audio sub-signal, a second left channel input audio sub-signal, a third left channel input audio sub-signal, and a fourth left channel input audio sub-signal, and to decompose the right channel input audio signal R into a first right channel input audio sub-signal, a second right channel input audio sub-signal, a third right channel input audio sub-signal, and a fourth right channel input audio sub-signal, wherein the first left channel input audio sub-signal and the first right channel input audio sub-signal are allocated to a first predetermined frequency band, wherein the second left channel input audio sub-signal and the second right channel input audio sub-signal are allocated to a second predetermined frequency band, wherein the third left channel input audio sub-signal and the third right channel input audio sub-signal are allocated to a third predetermined frequency band, and wherein the fourth left channel input audio sub-signal and the fourth right channel input audio sub-signal are allocated to the fourth predetermined frequency band. The decomposer 101 can be an audio crossover network.

The audio signal processing apparatus 100 further comprises a first cross-talk reducer 103 being configured to reduce a cross-talk between the first left channel input audio sub-signal and the first right channel input audio sub-signal within the first predetermined frequency band upon the basis of the ATF matrix H to obtain a first left channel output audio sub-signal and a first right channel output audio sub-signal, and a second cross-talk reducer 105 being configured to reduce a cross-talk between the second left channel input audio sub-signal and the second right channel input audio sub-signal within the second predetermined frequency band upon the basis of the ATF matrix H to obtain a second left channel output audio sub-signal and a second right channel output audio sub-signal.

The audio signal processing apparatus 100 further comprises a joint delayer 501. The joint delayer 501 is configured to delay the third left channel input audio sub-signal within the third predetermined frequency band by a time delay $d_{11}$ to obtain a third left channel output audio sub-signal, and to delay the third right channel input audio sub-signal within the third predetermined frequency band by a further time delay $d_{22}$ to obtain a third right channel output audio sub-signal. The joint delayer 501 is further configured to delay the fourth left channel input audio sub-signal within the fourth predetermined frequency band by the time delay $d_{11}$ to obtain a fourth left channel output audio sub-signal, and to delay the fourth right channel input audio sub-signal within the fourth predetermined frequency band by the further time delay $d_{22}$ to obtain a fourth right channel output audio sub-signal.

The joint delayer 501 can comprise a delayer being configured to delay the third left channel input audio sub-signal within the third predetermined frequency band by the time delay $d_{11}$ to obtain the third left channel output audio sub-signal, and to delay the third right channel input audio sub-signal within the third predetermined frequency band by the further time delay $d_{22}$ to obtain the third right channel output audio sub-signal. The joint delayer 501 can comprise a further delayer being configured to delay the fourth left channel input audio sub-signal within the fourth predetermined frequency band by the time delay $d_{11}$ to obtain the fourth left channel output audio sub-signal, and to delay the fourth right channel input audio sub-signal within the fourth predetermined frequency band by the further time delay $d_{22}$ to obtain the fourth right channel output audio sub-signal.

The audio signal processing apparatus 100 further comprises a combiner 107 being configured to combine the first left channel output audio sub-signal, the second left channel output audio sub-signal, the third left channel output audio sub-signal, and the fourth left channel output audio sub-signal to obtain the left channel output audio signal $X_1$, and to combine the first right channel output audio sub-signal, the second right channel output audio sub-signal, the third right channel output audio sub-signal, and the fourth right channel output audio sub-signal to obtain the right channel output audio signal $X_2$. The combination can be performed by addition.

Embodiments of the disclosure are based on performing the cross-talk reduction in different predetermined frequency bands and choosing an optimal design principle for each predetermined frequency band in order to maximize the accuracy of relevant binaural cues and to minimize complexity. The frequency decomposition can be achieved by the decomposer 101 using e.g. a low-complexity filter bank and/or an audio crossover network.

The cut-off frequencies can e.g. be selected to match acoustic properties of the reproducing loudspeakers 303, 305 and/or human sound perception. The frequency $f_0$ can be set according to a cut-off frequency of the loudspeakers 303, 305, e.g. 200 to 400 Hz. The frequency $f_1$ can be set e.g. smaller than 1.6 kHz, which can be a limit at which inter-aural time differences (ITDs) are dominant. The frequency $f_2$ can be set e.g. smaller than 8 kHz. Above this frequency, head-related transfer functions (HRTFs) can vary significantly among listeners resulting in erroneous 3D sound localization and undesired coloration. Thus, it can be desirable to avoid any processing at these frequencies in order to preserve sound quality.

With this approach, each predetermined frequency band can be optimized so that important binaural cues are preserved: inter-aural time differences (ITDs) at low frequencies, i.e. in sub-band $S_1$, inter-aural level differences (ILDs) at middle frequencies, i.e. in sub-band $S_2$. The naturalness of the sound can be preserved at very low frequencies and high frequencies, i.e. in sub-bands $S_0$. This way, a virtual sound effect can be achieved, while complexity and coloration are reduced.

At middle frequencies between $f_1$ and $f_2$, i.e. in sub-band $S_2$, a conventional cross-talk reduction can be used by the second cross-talk reducer 105 according to:

$$C=(H^H H+\beta(\omega)I)^{-1}H^H e^{-j\omega M} \tag{3}$$

wherein a regularization factor $\beta(\omega)$ can be set to a very small number, e.g. 1e-8, in order to achieve stability. A second cross-talk reduction matrix $C_{S2}$ can be determined firstly for a whole frequency range, e.g. 20 Hz to 20 kHz, and then band-pass filtered between $f_1$ and $f_2$ according to:

$$C_{S2}=BP(H^H H+\beta(\omega)I)^{-1}H^H e^{-j\omega M} \tag{4}$$

wherein BP denotes a frequency response of a corresponding band-pass filter.

For frequencies between $f_1$ and $f_2$, e.g. between 1.6 kHz and 8 kHz, the equation system can be rather well conditioned, meaning that less regularization may be used and thus less coloration may be introduced. In this frequency range, inter-aural level differences (ILDs) can be dominant and can be maintained with this approach. A byproduct of the band limitation can be that shorter filters can be obtained, further reducing complexity in this way.

Figure 6:
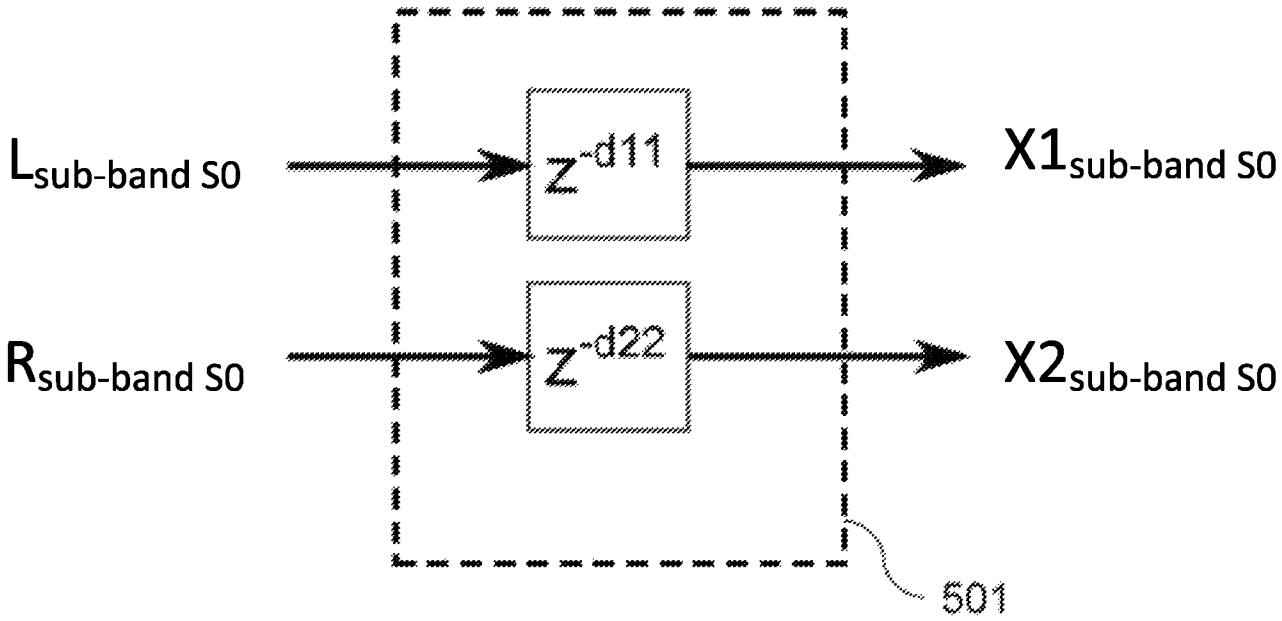
FIG. 6 shows a diagram of a joint delayer for delaying a third left channel input audio sub-signal, a third right channel input audio sub-signal, a fourth left channel input audio sub-signal, and a fourth right channel input audio sub-signal according to an embodiment.

FIG. 6 shows a diagram of a joint delayer 501 according to an embodiment. The joint delayer 501 can realized time delays in order to bypass very low and high frequencies.

The joint delayer 501 is configured to delay the third left channel input audio sub-signal within the third predetermined frequency band by a time delay $d_{11}$ to obtain a third left channel output audio sub-signal, and to delay the third right channel input audio sub-signal within the third predetermined frequency band by a further time delay $d_{22}$ to obtain a third right channel output audio sub-signal. The joint delayer 501 is further configured to delay the fourth left channel input audio sub-signal within the fourth predetermined frequency band by the time delay $d_{11}$ to obtain a fourth left channel output audio sub-signal, and to delay the fourth right channel input audio sub-signal within the fourth predetermined frequency band by the further time delay $d_{22}$ to obtain a fourth right channel output audio sub-signal.

Frequencies below $f_0$ and above $f_2$, i.e. in sub-bands $S_0$, can be bypassed using simple time delays. Below the cut-off frequencies of the loudspeakers 303, 305, i.e. below frequency $f_0$, it may not be desirable to perform any processing. Above frequency $f_2$, e.g. 8 kHz, individual differences between head-related transfer functions (HRTFs) may be difficult to invert. Thus, no cross-talk reduction may be intended in these predetermined frequency bands. A simple time delay which matches a constant time delay of the cross-talk reducers in the diagonal of the cross-talk reduction matrix C, i.e. $C_{ii}$, can be used in order to avoid coloration due to a comb-filtering effect.

Figure 7:
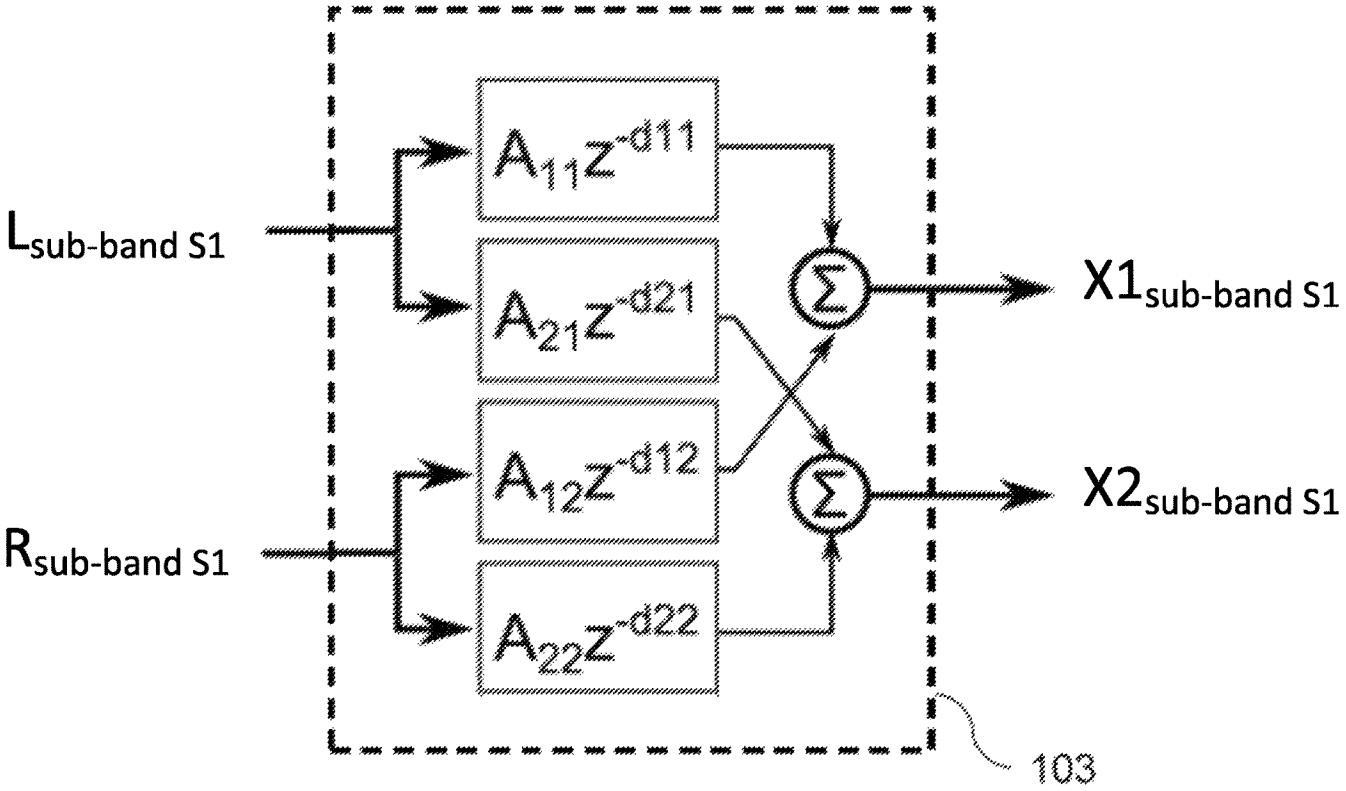
FIG. 7 shows a diagram of a first cross-talk reducer for reducing a cross-talk between a first left channel input audio sub-signal and a first right channel input audio sub-signal according to an embodiment.

FIG. 7 shows a diagram of a first cross-talk reducer 103 for reducing a cross-talk between a first left channel input audio sub-signal and a first right channel input audio sub-signal according to an embodiment. The first cross-talk reducer 103 can be applied for cross-talk reduction at low frequencies.

At low frequencies, typically below 1 kHz, a large regularization may be used in order to control the gain and to avoid an over-driving of the loudspeakers 303, 305. This can result in a loss of dynamic range and a wrong spatial rendering. Since inter-aural time differences (ITDs) can be dominant at frequencies below 1.6 kHz, it can be desirable to render accurate inter-aural time differences (ITDs) in this predetermined frequency band.

Embodiments of the disclosure apply a design methodology which approximates the first cross-talk reduction matrix $C_{S1}$ at low frequencies to realize simple gains and time delays by using only linear phase information of cross-talk reduction responses according to:

$$C_{S1} = \begin{bmatrix} A_{11}z^{-d_{11}} & A_{12}z^{-d_{12}} \\ A_{21}z^{-d_{21}} & A_{22}z^{-d_{22}} \end{bmatrix} \tag{3}$$

wherein $$A_{ij}=\max\{|C_{ij}|\}\cdot\mathrm{sign}(C_{ijmax})$$

denotes a magnitude of a maximum value of a full-band cross-talk reduction element $C_{ij}$ of the cross-talk reduction matrix C, e.g. a generic cross-talk reduction matrix calculated for the whole frequency range, and $d_{ij}$ denotes the constant time delay of $C_{ij}$.

With this approach, inter-aural time differences (ITDs) can be accurately reproduced while sound quality may not be compromised, given that large regularization values in this range may not be applied.

Figure 8:
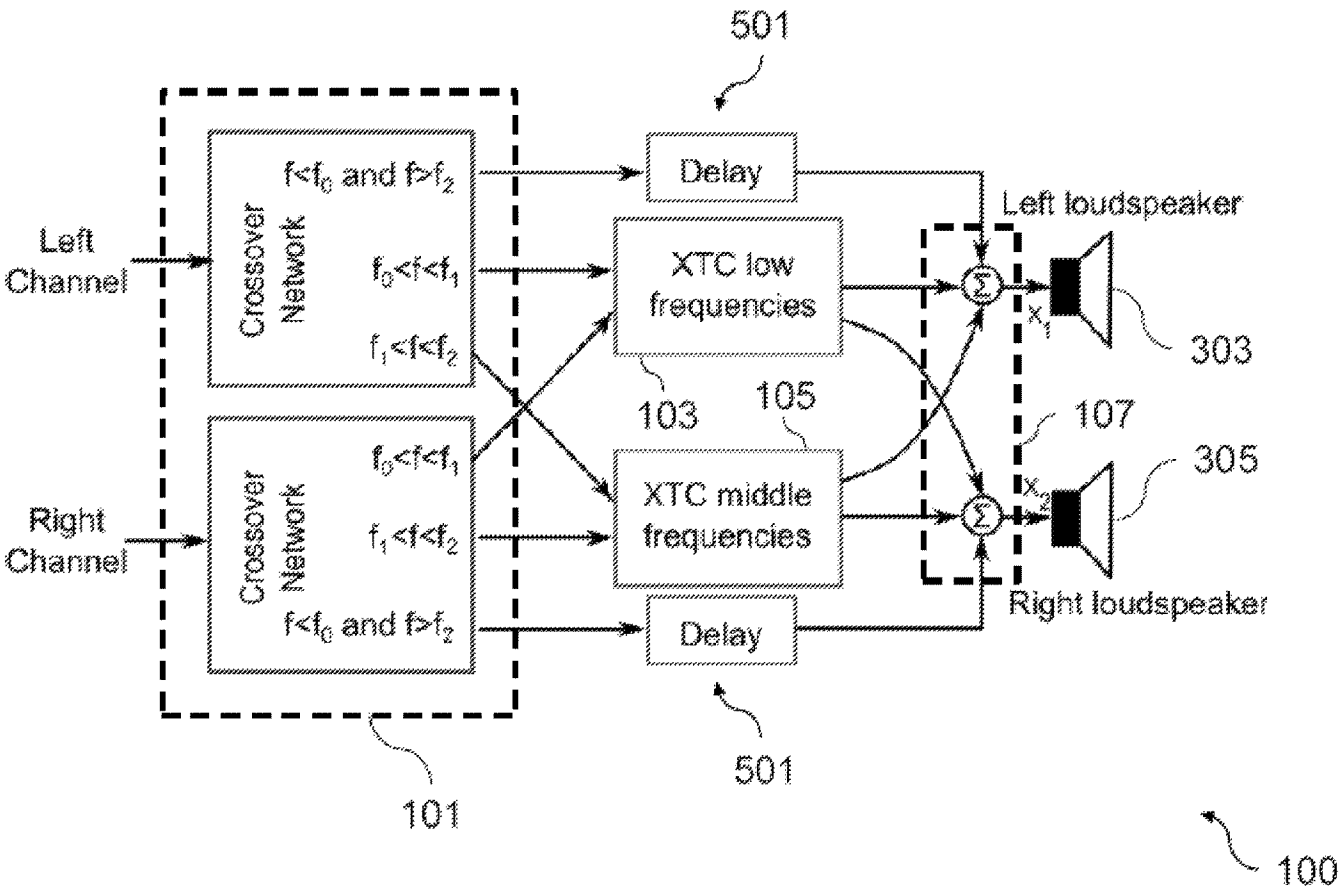
FIG. 8 shows a diagram of an audio signal processing apparatus for filtering a left channel input audio signal and a right channel input audio signal according to an embodiment.

FIG. 8 shows a diagram of an audio signal processing apparatus 100 according to an embodiment. The audio signal processing apparatus 100 is adapted to filter a left channel input audio signal L to obtain a left channel output audio signal X1 and to filter a right channel input audio signal R to obtain a right channel output audio signal X2. The diagram refers to a two-input two-output embodiment.

The left channel output audio signal X1 and the right channel output audio signal X2 are to be transmitted over acoustic propagation paths to a listener, wherein transfer functions of the acoustic propagation paths are defined by an ATF matrix H.

The audio signal processing apparatus 100 comprises a decomposer 101 being configured to decompose the left channel input audio signal L into a first left channel input audio sub-signal, a second left channel input audio sub-signal, a third left channel input audio sub-signal, and a fourth left channel input audio sub-signal, and to decompose the right channel input audio signal R into a first right channel input audio sub-signal, a second right channel input audio sub-signal, a third right channel input audio sub-signal, and a fourth right channel input audio sub-signal, wherein the first left channel input audio sub-signal and the first right channel input audio sub-signal are allocated to a first predetermined frequency band, wherein the second left channel input audio sub-signal and the second right channel input audio sub-signal are allocated to a second predetermined frequency band, wherein the third left channel input audio sub-signal and the third right channel input audio sub-signal are allocated to a third predetermined frequency band, and wherein the fourth left channel input audio sub-signal and the fourth right channel input audio sub-signal are allocated to the fourth predetermined frequency band. The decomposer 101 can comprise a first audio crossover network for the left channel input audio signal L, and a second audio crossover network for the right channel input audio signal R.

The audio signal processing apparatus 100 further comprises a first cross-talk reducer 103 being configured to reduce a cross-talk between the first left channel input audio sub-signal and the first right channel input audio sub-signal within the first predetermined frequency band upon the basis of the ATF matrix H to obtain a first left channel output audio sub-signal and a first right channel output audio sub-signal, and a second cross-talk reducer 105 being configured to reduce a cross-talk between the second left channel input audio sub-signal and the second right channel input audio sub-signal within the second predetermined frequency band upon the basis of the ATF matrix H to obtain a second left channel output audio sub-signal and a second right channel output audio sub-signal.

The audio signal processing apparatus 100 further comprises a joint delayer 501. The joint delayer 501 is configured to delay the third left channel input audio sub-signal within the third predetermined frequency band by a time delay d11 to obtain a third left channel output audio sub-signal, and to delay the third right channel input audio sub-signal within the third predetermined frequency band by a further time delay d22 to obtain a third right channel output audio sub-signal. The joint delayer 501 is further configured to delay the fourth left channel input audio sub-signal within the fourth predetermined frequency band by the time delay d11 to obtain a fourth left channel output audio sub-signal, and to delay the fourth right channel input audio sub-signal within the fourth predetermined frequency band by the further time delay d22 to obtain a fourth right channel output audio sub-signal. For ease of illustration, the joint delayer 501 is shown in a distributed manner in the figure.

The joint delayer 501 can comprise a delayer being configured to delay the third left channel input audio sub-signal within the third predetermined frequency band by the time delay d11 to obtain the third left channel output audio sub-signal, and to delay the third right channel input audio sub-signal within the third predetermined frequency band by the further time delay d22 to obtain the third right channel output audio sub-signal. The joint delayer 501 can comprise a further delayer being configured to delay the fourth left channel input audio sub-signal within the fourth predetermined frequency band by the time delay d11 to obtain the fourth left channel output audio sub-signal, and to delay the fourth right channel input audio sub-signal within the fourth predetermined frequency band by the further time delay d22 to obtain the fourth right channel output audio sub-signal.

The audio signal processing apparatus 100 further comprises a combiner 107 being configured to combine the first left channel output audio sub-signal, the second left channel output audio sub-signal, the third left channel output audio sub-signal, and the fourth left channel output audio sub-signal to obtain the left channel output audio signal X1, and to combine the first right channel output audio sub-signal, the second right channel output audio sub-signal, the third right channel output audio sub-signal, and the fourth right channel output audio sub-signal to obtain the right channel output audio signal X2. The combination can be performed by addition. The left channel output audio signal X1 is transmitted via the left loudspeaker 303. The right channel output audio signal X2 is transmitted via the right loudspeaker 305.

The audio signal processing apparatus 100 can be applied for binaural audio reproduction and/or stereo widening. The decomposition into sub-bands by the decomposer 101 can be performed considering the acoustic properties of the loudspeakers 303, 305.

The cross-talk reduction or cross-talk cancellation (XTC) by the second cross-talk reducer 105 at middle frequencies can depend on the loudspeaker span angle between the loudspeakers 303, 305 and an approximated distance to a listener. For this purpose, measurements, generic head-related transfer functions (HRTFs) or a head-related transfer function (HRTF) model can be used. The time delays and gains of the cross-talk reduction by the first cross-talk reducer 103 at low frequencies can be obtained from a generic cross-talk reduction approach within the whole frequency range.

Embodiments of the disclosure employ a virtual cross-talk reduction approach, wherein the cross-talk reduction matrices and/or filters are optimized in order to model a cross-talk signal and a direct audio signal of desired virtual loudspeakers instead of reducing a cross-talk of real loudspeakers. A combination using a different low frequency cross-talk reduction and middle frequency cross-talk reduction can also be used. For example, time delays and gains for low frequencies can be obtained from the virtual cross-talk reduction approach, while at middle frequencies a conventional cross-talk reduction can be applied or vice versa.

Figure 9:
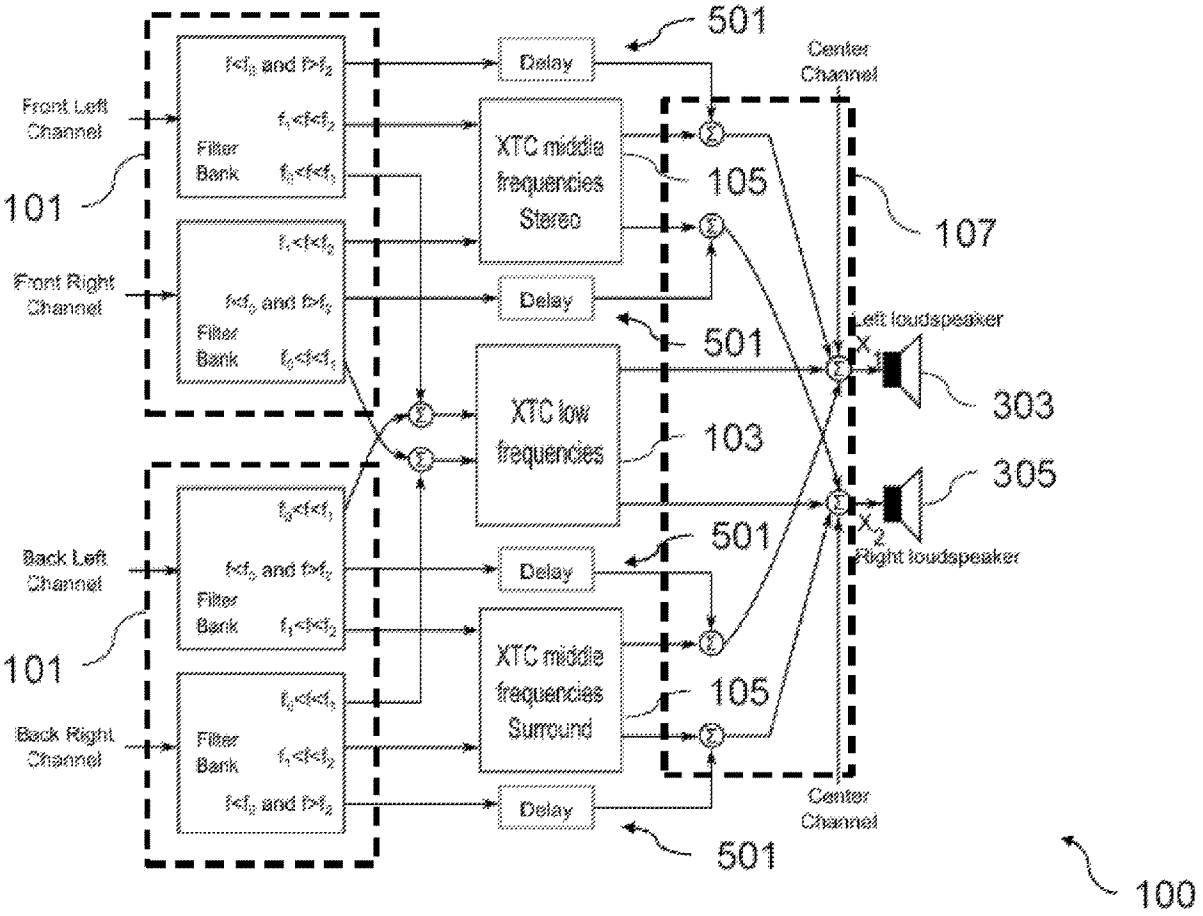
FIG. 9 shows a diagram of an audio signal processing apparatus for filtering a left channel input audio signal and a right channel input audio signal according to an embodiment.

FIG. 9 shows a diagram of an audio signal processing apparatus 100 according to an embodiment. The audio signal processing apparatus 100 is adapted to filter a left channel input audio signal L to obtain a left channel output audio signal X1 and to filter a right channel input audio signal R to obtain a right channel output audio signal X2. The diagram refers to a virtual surround audio system for filtering a multi-channel audio signal.

The audio signal processing apparatus 100 comprises two decomposers 101, a first cross-talk reducer 103, two second cross-talk reducers 105, joint delayers 501, and a combiner 107 having the same functionality as described in conjunction with FIG. 8. The left channel output audio signal X1 is transmitted via a left loudspeaker 303. The right channel output audio signal X2 is transmitted via a right loudspeaker 305.

In the upper portion of the diagram, the left channel input audio signal L is formed by a front left channel input audio signal of the multi-channel input audio signal and the right channel input audio signal R is formed by a front right channel input audio signal of the multi-channel input audio signal. In the lower portion of the diagram, the left channel input audio signal L is formed by a back left channel input audio signal of the multi-channel input audio signal and the right channel input audio signal R is formed by a back right channel input audio signal of the multi-channel input audio signal.

The multi-channel input audio signal further comprises a center channel input audio signal, wherein the combiner 107 is configured to combine the center channel input audio signal and the left channel output audio sub-signals to obtain the left channel output audio signal X1, and to combine the center channel input audio signal and the right channel output audio sub-signals to obtain the right channel output audio signal X2.

Low frequencies of all channels can be mixed down and processed with the first cross-talk reducer 103 at low frequencies, wherein time delays and gains may only be applied. Thus, only one first cross-talk reducer 103 may be employed, which further reduces complexity.

Middle frequencies of the front and back channels can be processed using different cross-talk reduction approaches in order to improve a virtual surround experience. The center channel input audio signal can be left unprocessed in order to reduce latency.

Embodiments of the disclosure employ a virtual cross-talk reduction approach, wherein the cross-talk reduction matrices and/or filters are optimized in order to model a cross-talk signal and a direct audio signal of desired virtual loudspeakers instead of reducing a cross-talk of real loudspeakers.

Figure 10:
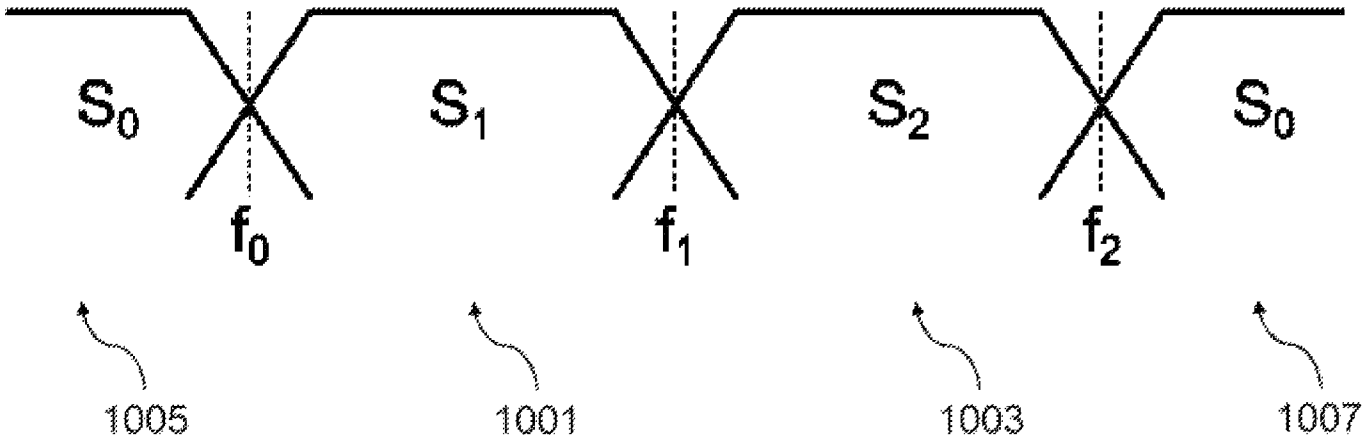
FIG. 10 shows a diagram of an allocation of frequencies to predetermined frequency bands according to an embodiment.

FIG. 10 shows a diagram of an allocation of frequencies to predetermined frequency bands according to an embodiment. The allocation can be performed by a decomposer 101. The diagram illustrates a general scheme of frequency allocation. Si denotes the different sub-bands, wherein different approaches can be applied within the different sub-bands.

Low frequencies between f0 and f1 are allocated to a first predetermined frequency band 1001 forming a sub-band S1. Middle frequencies between f1 and f2 are allocated to a second predetermined frequency band 1003 forming a sub-band S2. Very low frequencies below f0 are allocated to a third predetermined frequency band 1005 forming a sub-band S0. High frequencies above f2 are allocated to a fourth predetermined frequency band 1007 forming a further sub-band S0.

Figure 11:
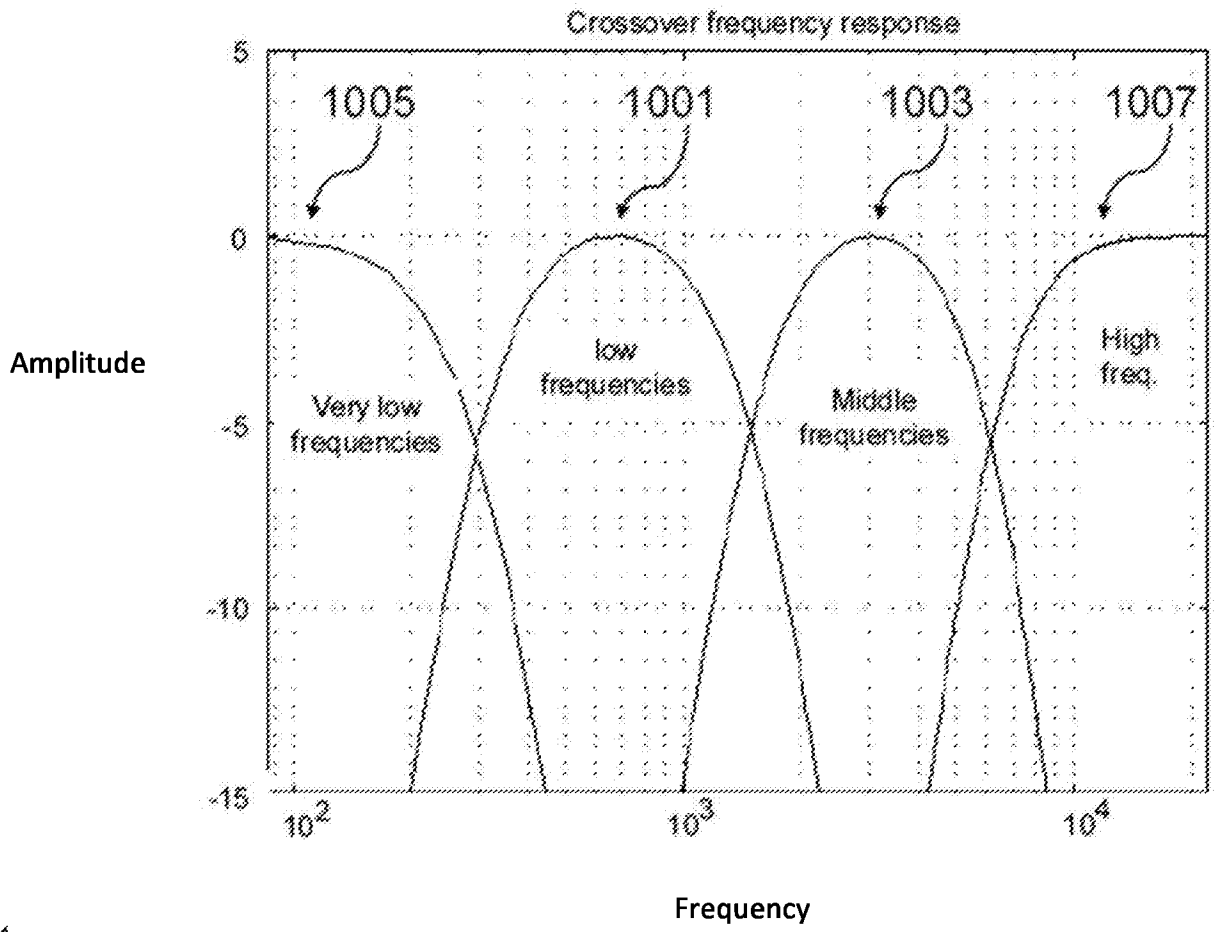
FIG. 11 shows a diagram of a frequency response of an audio crossover network according to an embodiment.

FIG. 11 shows a diagram of a frequency response of an audio crossover network according to an embodiment. The audio crossover network can comprise a filter bank.

Low frequencies between f0 and f1 are allocated to a first predetermined frequency band 1001 forming a sub-band S1. Middle frequencies between f1 and f2 are allocated to a second predetermined frequency band 1003 forming a sub-band S2. Very low frequencies below f0 are allocated to a third predetermined frequency band 1005 forming a sub-band S0. High frequencies above f2 are allocated to a fourth predetermined frequency band 1007 forming a further sub-band S0.

Embodiments of the disclosure are based on a design methodology that enables an accurate reproduction of binaural cues while preserving sound quality. Because low frequency components are processed using simple time delays and gains, less regularization may be employed. There may be no optimization of a regularization factor, which further reduces complexity of the filter design. Due to a narrow band approach, shorter filters are applied.

The approach can easily be adapted to different listening conditions, such as for tablets, smartphones, TVs, and home theaters. Binaural cues are accurately reproduced in their frequency range of relevance. That is, realistic 3D sound effects can be achieved without compromising the sound quality. Moreover, robust filters can be used, which results in a wider sweet spot. The approach can be employed with any loudspeaker configuration, e.g. using different span angles, geometries and/or loudspeaker sizes, and can easily be extended to more than two audio channels.

Embodiments of the disclosure apply the cross-talk reduction within different predetermined frequency bands or sub-bands and choose an optimal design principle for each predetermined frequency band or sub-band in order to maximize the accuracy of relevant binaural cues and to minimize complexity.

Embodiments of the disclosure relate to an audio signal processing apparatus 100 and an audio signal processing method 200 for virtual sound reproduction through at least two loudspeakers using sub-band decomposition based on perceptual cues. The approach comprises a low frequency cross-talk reduction applying only time delays and gains, and a middle frequency cross-talk reduction using a conventional cross-talk reduction approach and/or a virtual cross-talk reduction approach.

Embodiments of the disclosure are applied within audio terminals having at least two loudspeakers such as TVs, high fidelity (HiFi) systems, cinema systems, mobile devices such as smartphone or tablets, or teleconferencing systems. Embodiments of the disclosure are implemented in semiconductor chipsets.

Embodiments of the disclosure may be implemented in a computer program for running on a computer system, at least including code portions for performing steps of a method according to the disclosure when run on a programmable apparatus, such as a computer system or enabling a programmable apparatus to perform functions of a device or system according to the disclosure.

A computer program is a list of instructions such as a particular application program and/or an operating system. The computer program may for instance include one or more of: a subroutine, a function, a procedure, an object method, an object implementation, an executable application, an applet, a servlet, a source code, an object code, a shared library/dynamic load library and/or other sequence of instructions designed for execution on a computer system.

The computer program may be stored internally on computer readable storage medium or transmitted to the computer system via a computer readable transmission medium. All or some of the computer program may be provided on transitory or non-transitory computer readable media permanently, removably or remotely coupled to an information processing system. The computer readable media may include, for example and without limitation, any number of the following: magnetic storage media including disk and tape storage media; optical storage media such as compact disk media (e.g., CD-ROM, CD-R, etc.) and digital video disk storage media; nonvolatile memory storage media including semiconductor-based memory units such as FLASH memory, EEPROM, EPROM, ROM; ferromagnetic digital memories; MRAM; volatile storage media including registers, buffers or caches, main memory, RAM, etc.; and data transmission media including computer networks, point-to-point telecommunication equipment, and carrier wave transmission media, just to name a few.

A computer process typically includes an executing (running) program or portion of a program, current program values and state information, and the resources used by the operating system to manage the execution of the process. An operating system (OS) is the software that manages the sharing of the resources of a computer and provides programmers with an interface used to access those resources. An operating system processes system data and user input, and responds by allocating and managing tasks and internal system resources as a service to users and programs of the system.

The computer system may for instance include at least one processing unit, associated memory and a number of input/output (I/O) devices. When executing the computer program, the computer system processes information according to the computer program and produces resultant output information via I/O devices.

The connections as discussed herein may be any type of connection suitable to transfer signals from or to the respective nodes, units or devices, for example via intermediate devices. Accordingly, unless implied or stated otherwise, the connections may for example be direct connections or indirect connections. The connections may be illustrated or described in reference to being a single connection, a plurality of connections, unidirectional connections, or bidirectional connections. However, different embodiments may vary the implementation of the connections. For example, separate unidirectional connections may be used rather than bidirectional connections and vice versa. Also, plurality of connections may be replaced with a single connection that transfers multiple signals serially or in a time multiplexed manner. Likewise, single connections carrying multiple signals may be separated out into various different connections carrying subsets of these signals. Therefore, many options exist for transferring signals.

Those skilled in the art will recognize that the boundaries between logic blocks are merely illustrative and that alternative embodiments may merge logic blocks or circuit elements or impose an alternate decomposition of functionality upon various logic blocks or circuit elements. Thus, it is to be understood that the architectures depicted herein are merely exemplary, and that in fact many other architectures can be implemented which achieve the same functionality.

Thus, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected," or "operably coupled," to each other to achieve the desired functionality.

Furthermore, those skilled in the art will recognize that boundaries between the above described operations merely illustrative. The multiple operations may be combined into a single operation, a single operation may be distributed in additional operations and operations may be executed at least partially overlapping in time. Moreover, alternative embodiments may include multiple instances of a particular operation, and the order of operations may be altered in various other embodiments.

Also for example, the examples, or portions thereof, may implemented as soft or code representations of physical circuitry or of logical representations convertible into physical circuitry, such as in a hardware description language of any appropriate type.

Also, the disclosure is not limited to physical devices or units implemented in nonprogrammable hardware but can also be applied in programmable devices or units able to perform the desired device functions by operating in accordance with suitable program code, such as mainframes, minicomputers, servers, workstations, personal computers, notepads, personal digital assistants, electronic games, automotive and other embedded systems, cell phones and various other wireless devices, commonly denoted in this application as 'computer systems'.

However, other modifications, variations and alternatives are also possible. The specifications and drawings are, accordingly, to be regarded in an illustrative rather than in a restrictive sense.

What is claimed is:

1. An audio signal processing apparatus for filtering a left channel input audio signal (L) to obtain a left channel output audio signal ($X_1$) and for filtering a right channel input audio signal (R) to obtain a right channel output audio signal ($X_2$), the left channel output audio signal ($X_1$) and the right channel output audio signal ($X_2$) to be transmitted over acoustic propagation paths to a listener, wherein transfer functions of the acoustic propagation paths are defined by an acoustic transfer function (ATF) matrix (H), the audio signal processing apparatus comprising:

a processor and a plurality of modules executable by the processor, wherein the plurality of modules include:

a decomposer configured to decompose the left channel input audio signal (L) into a first left channel input audio sub-signal and a second left channel input audio sub-signal, and to decompose the right channel input audio signal (R) into a first right channel input audio sub-signal and a second right channel input audio sub-signal, wherein the first left channel input audio sub-signal and the first right channel input audio sub-signal are allocated to a first predetermined frequency band, and wherein the second left channel input audio sub-signal and the second right channel input audio sub-signal are allocated to a second predetermined frequency band;

a first cross-talk reducer configured to reduce cross-talk between the first left channel input audio sub-signal and the first right channel input audio sub-signal within the first predetermined frequency band upon the basis of the ATF matrix (H) to obtain a first left channel output audio sub-signal and a first right channel output audio sub-signal;

a second cross-talk reducer configured to reduce cross-talk between the second left channel input audio sub-signal and the second right channel input audio sub-signal within the second predetermined frequency band upon the basis of the ATF matrix (H) to obtain a second left channel output audio sub-signal and a second right channel output audio sub-signal; and a combiner configured to combine the first left channel output audio sub-signal and the second left channel output audio sub-signal to obtain the left channel output audio signal ($X_1$), and to combine the first right channel output audio sub-signal and the second right channel output audio sub-signal to obtain the right channel output audio signal ($X_2$).

2. The audio signal processing apparatus of claim 1, wherein the left channel output audio signal ($X_1$) is to be transmitted over a first acoustic propagation path between a left loudspeaker and a left ear of the listener and a second acoustic propagation path between the left loudspeaker and a right ear of the listener, wherein the right channel output audio signal ($X_2$) is to be transmitted over a third acoustic propagation path between a right loudspeaker and the right ear of the listener and a fourth acoustic propagation path between the right loudspeaker and the left ear of the listener, and wherein a first transfer function ($H_{L1}$) of the first acoustic propagation path, a second transfer function ($H_{R1}$) of the second acoustic propagation path, a third transfer function ($H_{R2}$) of the third acoustic propagation path, and a fourth transfer function ($H_{L2}$) of the fourth acoustic propagation path form the ATF matrix (H).

3. The audio signal processing apparatus of claim 1, wherein the first cross-talk reducer is configured to determine a first cross-talk reduction matrix ($C_{S1}$) upon the basis of the ATF matrix (H), and to filter the first left channel input audio sub-signal and the first right channel input audio sub-signal upon the basis of the first cross-talk reduction matrix ($C_{S1}$).

4. The audio signal processing apparatus of claim 3, wherein elements of the first cross-talk reduction matrix ($C_{S1}$) indicate gains ($A_{ij}$) and time delays ($d_{ij}$) associated with the first left channel input audio sub-signal and the first right channel input audio sub-signal, and wherein the gains ($A_{ij}$) and the time delays ($d_{ij}$) are constant within the first predetermined frequency band.

5. The audio signal processing apparatus of claim 4, wherein the first cross-talk reducer is configured to determine the first cross-talk reduction matrix ($C_{S1}$) according to the following equations:

$$C_{S1} = \begin{bmatrix} A_{11}z^{-d_{11}} & A_{12}z^{-d_{12}} \\ A_{21}z^{-d_{21}} & A_{22}z^{-d_{22}} \end{bmatrix}$$

$$A_{ij} = \max\{|C_{ij}|\} \cdot \mathrm{sign}(C_{ijmax})$$

$$C = (H^H H + \beta(\omega)I)^{-1} H^H e^{-j\omega M}$$

wherein $C_{S1}$ denotes the first cross-talk reduction matrix, $A_{ij}$ denotes the gains, $d_{ij}$ denotes the time delays, C denotes a generic cross-talk reduction matrix, $C_{ij}$ denotes elements of the generic cross-talk reduction matrix, $C_{ijmax}$ denotes a maximum value of the elements $C_{ij}$ of the generic cross-talk reduction matrix, i identifies a row of the generic cross-talk reduction matrix, j identifies a column of the generic cross-talk reduction matrix, H denotes the ATF matrix, I denotes an identity matrix, β denotes a regularization factor, M denotes a modelling delay, and ω denotes an angular frequency.

6. The audio signal processing apparatus of claim 1, wherein the second cross-talk reducer is configured to determine a second cross-talk reduction matrix ($C_{S2}$) upon the basis of the ATF matrix (H), and to filter the second left channel input audio sub-signal and the second right channel input audio sub-signal upon the basis of the second cross-talk reduction matrix ($C_{S2}$).

7. The audio signal processing apparatus of claim 6, wherein the second cross-talk reducer is configured to determine the second cross-talk reduction matrix ($C_{S2}$) according to the following equation:

$$C_{S2}=BP(H^H H+\beta(\omega)I)^{-1}H^H e^{-j\omega M}$$

wherein $C_{S2}$ denotes the second cross-talk reduction matrix, H denotes the ATF matrix, I denotes an identity matrix, BP denotes a band-pass filter, β denotes a regularization factor, M denotes a modelling delay, and ω denotes an angular frequency.

8. The audio signal processing apparatus of claim 1, wherein the plurality of modules further include:

a delayer configured to delay a third left channel input audio sub-signal within a third predetermined frequency band by a time delay ($d_{11}$) to obtain a third left channel output audio sub-signal, and to delay a third right channel input audio sub-signal within the third predetermined frequency band by a further time delay ($d_{22}$) to obtain a third right channel output audio sub-signal;

wherein the decomposer is configured to decompose the left channel input audio signal (L) into the first left channel input audio sub-signal, the second left channel input audio sub-signal, and the third left channel input audio sub-signal, and to decompose the right channel input audio signal (R) into the first right channel input audio sub-signal, the second right channel input audio sub-signal, and the third right channel input audio sub-signal, wherein the third left channel input audio sub-signal and the third right channel input audio sub-signal are allocated to the third predetermined frequency band; and wherein the combiner is configured to combine the first left channel output audio sub-signal, the second left channel output audio sub-signal, and the third left channel output audio sub-signal to obtain the left channel output audio signal ($X_1$), and to combine the first right channel output audio sub-signal, the second right channel output audio sub-signal, and the third right channel output audio sub-signal to obtain the right channel output audio signal ($X_2$).

9. The audio signal processing apparatus of claim 8, wherein the plurality of modules further include:

a further delayer configured to delay a fourth left channel input audio sub-signal within a fourth predetermined frequency band by the time delay ($d_{11}$) to obtain a fourth left channel output audio sub-signal, and to delay a fourth right channel input audio sub-signal within the fourth predetermined frequency band by the further time delay ($d_{22}$) to obtain a fourth right channel output audio sub-signal;

wherein the decomposer is configured to decompose the left channel input audio signal (L) into the first left channel input audio sub-signal, the second left channel input audio sub-signal, the third left channel input audio sub-signal, and the fourth left channel input audio sub-signal, and to decompose the right channel input audio signal (R) into the first right channel input audio sub-signal, the second right channel input audio sub-signal, the third right channel input audio sub-signal, and the fourth right channel input audio sub-signal, wherein the fourth left channel input audio sub-signal and the fourth right channel input audio sub-signal are allocated to the fourth predetermined frequency band; and wherein the combiner is configured to combine the first left channel output audio sub-signal, the second left channel output audio sub-signal, the third left channel output audio sub-signal, and the fourth left channel output audio sub-signal to obtain the left channel output audio signal ($X_1$), and to combine the first right channel output audio sub-signal, the second right channel output audio sub-signal, the third right channel output audio sub-signal, and the fourth right channel output audio sub-signal to obtain the right channel output audio signal ($X_2$).

10. The audio signal processing apparatus of claim 1, wherein the decomposer is an audio crossover network.

11. The audio signal processing apparatus of claim 1, wherein the combiner is configured to add the first left channel output audio sub-signal and the second left channel output audio sub-signal to obtain the left channel output audio signal ($X_1$), and to add the first right channel output audio sub-signal and the second right channel output audio sub-signal to obtain the right channel output audio signal ($X_2$).

12. The audio signal processing apparatus of claim 1, wherein the left channel input audio signal (L) is formed by a front left channel input audio signal of a multi-channel input audio signal and the right channel input audio signal (R) is formed by a front right channel input audio signal of the multi-channel input audio signal, or wherein the left channel input audio signal (L) is formed by a back left channel input audio signal of a multi-channel input audio signal and the right channel input audio signal (R) is formed by a back right channel input audio signal of the multi-channel input audio signal.

13. The audio signal processing apparatus of claim 12, wherein the multi-channel input audio signal comprises a center channel input audio signal, and wherein the combiner is configured to combine the center channel input audio signal, the first left channel output audio sub-signal, and the second left channel output audio sub-signal to obtain the left channel output audio signal ($X_1$), and to combine the center channel input audio signal, the first right channel output audio sub-signal, and the second right channel output audio sub-signal to obtain the right channel output audio signal ($X_2$).

14. An audio signal processing method for filtering a left channel input audio signal (L) to obtain a left channel output audio signal ($X_1$) and for filtering a right channel input audio signal (R) to obtain a right channel output audio signal ($X_2$), the left channel output audio signal ($X_1$) and the right channel output audio signal ($X_2$) to be transmitted over acoustic propagation paths to a listener, wherein transfer functions of the acoustic propagation paths are defined by an acoustic transfer function (ATF) matrix (H), the audio signal processing method comprising:

decomposing the left channel input audio signal (L) into a first left channel input audio sub-signal and a second left channel input audio sub-signal, and decomposing the right channel input audio signal (R) into a first right channel input audio sub-signal and a second right channel input audio sub-signal, wherein the first left channel input audio sub-signal and the first right channel input audio sub-signal are allocated to a first predetermined frequency band, and wherein the second left channel input audio sub-signal and the second right channel input audio sub-signal are allocated to a second predetermined frequency band;

reducing cross-talk between the first left channel input audio sub-signal and the first right channel input audio sub-signal within the first predetermined frequency band upon the basis of the ATF matrix (H) to obtain a first left channel output audio sub-signal and a first right channel output audio sub-signal;

reducing cross-talk between the second left channel input audio sub-signal and the second right channel input audio sub-signal within the second predetermined frequency band upon the basis of the ATF matrix (H) to obtain a second left channel output audio sub-signal and a second right channel output audio sub-signal;

combining the first left channel output audio sub-signal and the second left channel output audio sub-signal to obtain the left channel output audio signal ($X_1$); and combining the first right channel output audio sub-signal and the second right channel output audio sub-signal to obtain the right channel output audio signal ($X_2$).

15. A non-transitory computer readable medium having processor-executable instructions stored thereon for filtering a left channel input audio signal (L) to obtain a left channel output audio signal ($X_1$) and for filtering a right channel input audio signal (R) to obtain a right channel output audio signal ($X_2$), the left channel output audio signal ($X_1$) and the right channel output audio signal ($X_2$) to be transmitted over acoustic propagation paths to a listener, wherein transfer functions of the acoustic propagation paths are defined by an acoustic transfer function (ATF) matrix (H), wherein the processor-executable instructions, when executed by a processor, facilitate performance of the following:

decomposing the left channel input audio signal (L) into a first left channel input audio sub-signal and a second left channel input audio sub-signal, and decomposing the right channel input audio signal (R) into a first right channel input audio sub-signal and a second right channel input audio sub-signal, wherein the first left channel input audio sub-signal and the first right channel input audio sub-signal are allocated to a first predetermined frequency band, and wherein the second left channel input audio sub-signal and the second right channel input audio sub-signal are allocated to a second predetermined frequency band;

reducing cross-talk between the first left channel input audio sub-signal and the first right channel input audio sub-signal within the first predetermined frequency band upon the basis of the ATF matrix (H) to obtain a first left channel output audio sub-signal and a first right channel output audio sub-signal;

reducing cross-talk between the second left channel input audio sub-signal and the second right channel input audio sub-signal within the second predetermined frequency band upon the basis of the ATF matrix (H) to obtain a second left channel output audio sub-signal and a second right channel output audio sub-signal;

combining the first left channel output audio sub-signal and the second left channel output audio sub-signal to obtain the left channel output audio signal ($X_1$); and combining the first right channel output audio sub-signal and the second right channel output audio sub-signal to obtain the right channel output audio signal ($X_2$).

* * * * *